US012044444B2

(12) United States Patent
Matsuda et al.

(10) Patent No.: US 12,044,444 B2
(45) Date of Patent: Jul. 23, 2024

(54) REFRIGERATION CYCLE APPARATUS

(71) Applicant: Mitsubishi Electric Corporation, Tokyo (JP)

(72) Inventors: Takuya Matsuda, Tokyo (JP); Hiroaki Asanuma, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 325 days.

(21) Appl. No.: 17/615,470

(22) PCT Filed: Aug. 30, 2019

(86) PCT No.: PCT/JP2019/034210

§ 371 (c)(1),
(2) Date: Nov. 30, 2021

(87) PCT Pub. No.: WO2021/038852

PCT Pub. Date: Mar. 4, 2021

(65) Prior Publication Data

US 2022/0235972 A1 Jul. 28, 2022

(51) Int. Cl.

| | |
|---|---|
| ***F25B 49/02*** | (2006.01) |
| ***F25B 1/00*** | (2006.01) |
| ***F25B 43/00*** | (2006.01) |

(52) U.S. Cl.

CPC ..... *F25B 1/00* (2013.01); *F25B 43/006* (2013.01); *F25B 49/02* (2013.01); (Continued)

(58) Field of Classification Search

CPC ..... F25B 1/00; F25B 43/006; F25B 49/02; F25B 2313/02741; F25B 2313/0314; (Continued)

(56) References Cited

U.S. PATENT DOCUMENTS

| | | | | |
|---|---|---|---|---|
| 5,732,564 | A | 3/1998 | Misawa et al. | |
| 2015/0292932 | A1* | 10/2015 | Ochiai | G01F 23/246 62/498 |
| 2020/0271503 | A1 | 8/2020 | Asanuma et al. | |

FOREIGN PATENT DOCUMENTS

| | | | |
|---|---|---|---|
| JP | S62-158955 | A | 7/1987 |
| JP | H08-049930 | A | 2/1996 |

(Continued)

OTHER PUBLICATIONS

International Search Report of the International Searching Authority mailed Oct. 21, 2019 for the corresponding International application No. PCT/JP2019/034210 (and English translation).

*Primary Examiner* — Nael N Babaa
(74) *Attorney, Agent, or Firm* — Posz Law Group, PLC

(57) ABSTRACT

A refrigeration cycle apparatus includes a refrigerant circuit in which a compressor, a first heat exchanger, a first expansion device, a second expansion device, and a second heat exchanger are connected by refrigerant pipes and through which refrigerant circulates, an accumulator provided to the refrigerant circuit, formed to store liquid refrigerant, and from which gas refrigerant is caused to be sucked into the compressor, a liquid-level sensing device provided to the accumulator and sensing a liquid level of the liquid refrigerant stored in the accumulator, and a controller performs, in a case in which the liquid level sensed by the liquid-level sensing device is higher than a threshold, a limiting operation of reducing an amount of suction of the gas refrigerant that is sucked from the accumulator into the compressor and, in a case in which the liquid level is lower than or equal to the threshold, a normal operation.

4 Claims, 18 Drawing Sheets

(52) U.S. Cl.
CPC ..... *F25B 2313/02741* (2013.01); *F25B 2313/0314* (2013.01); *F25B 2600/2513* (2013.01); *F25B 2700/04* (2013.01); *F25B 2700/1931* (2013.01); *F25B 2700/21152* (2013.01)

(58) Field of Classification Search
CPC ..... F25B 2600/2513; F25B 2700/04; F25B 2700/1931; F25B 2700/21152
See application file for complete search history.

(56) References Cited

FOREIGN PATENT DOCUMENTS

| | | | |
|---|---|---|---|
| JP | 4295530 | B2 | 7/2009 |
| WO | 2017/221300 | A1 | 12/2017 |
| WO | 2019/065242 | A1 | 4/2019 |

* cited by examiner

REFRIGERATION CYCLE APPARATUS

CROSS REFERENCE TO RELATED APPLICATION

This application is a U.S. national stage application of International Application No. PCT/JP2019/034210 filed on Aug. 30, 2019, the contents of which are incorporated herein by reference.

TECHNICAL FIELD

The present disclosure relates to a refrigeration cycle apparatus.

BACKGROUND

As one of representative refrigeration cycle apparatuses, there is an air-conditioning apparatus. Some air-conditioning apparatus is provided with an accumulator formed to store excess refrigerant produced, for example, by a difference in operating condition between cooling operation and heating operation.

For example, an air-conditioning apparatus described in Patent Literature 1 includes an accumulator having a tank, an inlet pipe, and an outlet pipe. The tank stores excess refrigerant. The inlet pipe is connected to an upper part of the tank and through which evaporated refrigerant is guided into the tank. The outlet pipe has a U-shaped bent portion. In the outlet pipe, gas refrigerant is sucked through a gas suction opening and, through the outlet pipe, the gas refrigerant is delivered toward a compressor. Further, the outlet pipe has an oil return hole bored through the bent portion of the outlet pipe and through which refrigerating machine oil accumulated at the bottom of the tank is guided back to the compressor.

In the air-conditioning apparatus described in Patent Literature 1, a large amount of liquid refrigerant is temporarily stored in the tank of the accumulator during start-up of heating or during return after completion of defrosting in a case in which the outside air temperature is very low.

In a state in which a large amount of liquid refrigerant is stored in the tank of the accumulator, a large amount of liquid refrigerant is sucked into the compressor through the oil return hole, with the result that there is an increase in the amount of liquid return to the compressor. This is undesirable in terms of reliability of the compressor. The term "liquid return" means the suction of refrigerant into the compressor in the form of a liquid.

Further, activating the compressor in a state in which a large amount of liquid refrigerant is stored in the tank of the accumulator causes many oil contents to be released from the compressor into a refrigerant circuit, with the result that these oil contents are retained again in the accumulator together with liquid refrigerant. At this time, specific gravity brings about a state of commonly-called two-layer separation in which a layer of refrigerating machine oil is formed on top of a layer of liquid refrigerant accumulated in a lower part of the tank of the accumulator. In a state of occurrence of two-layer separation, the liquid refrigerant or the refrigerating machine oil is sucked into the compressor through the oil return hole, which is followed by the degree of flow differential pressure. Especially at low temperatures, there is a decrease in efficiency of oil return to the compressor, as there is an increase in viscosity of the refrigerating machine oil.

For this reason, the air-conditioning apparatus described in Patent Literature 1 is provided with a bypass through which a portion of hot gas discharged from the compressor is introduced into the bottom of the tank of the accumulator. Hot gas guided from the compressor into the bypass is injected into the bottom of the tank and blown up from the bottom toward the inside of the tank. In this manner, the layer of liquid refrigerant and the layer of refrigerating machine oil in the tank are efficiently stirred by the hot gas thus injected, quickly evaporate and gasify, and are guided into the compressor via the outlet pipe.

Thus, in the air-conditioning apparatus described in Patent Literature 1, providing the bypass through which a portion of hot gas discharged from the compressor is introduced brings about improvement in efficiency of oil return to the compressor by mixing together liquid refrigerant and refrigerating machine oil even in a state of occurrence of two-layer separation. This reduces liquid return to the compressor and brings about improvement in reliability of the compressor.

Patent Literature

Patent Literature 1: Japanese Patent No. 4295530

However, introducing hot gas through a direct bypass into the bottom of the tank of the accumulator as in the case of the air-conditioning apparatus described in Patent Literature 1 undesirably makes the tank of the accumulator complex in structure and makes the installation of pipes or other acts complex.

SUMMARY

The present disclosure has been made to solve such a problem and has an object to provide a refrigeration cycle apparatus configured to bring about improvement in reliability of a compressor without making an accumulator complex in structure.

A refrigeration cycle apparatus according to an embodiment of the present disclosure includes a refrigerant circuit in which a compressor, a first heat exchanger, a first expansion device, a second expansion device, and a second heat exchanger are connected by refrigerant pipes and through which refrigerant circulates, an accumulator provided to the refrigerant circuit, formed to store liquid refrigerant, and from which gas refrigerant is caused to be sucked into the compressor, a liquid-level sensing device provided to the accumulator and configured to sense a liquid level of the liquid refrigerant stored in the accumulator, and a controller configured to, in a case in which the liquid level sensed by the liquid-level sensing device is higher than a threshold, perform a limiting operation of reducing an amount of suction of the gas refrigerant that is sucked from the accumulator into the compressor and, in a case in which the liquid level is lower than or equal to the threshold, perform a normal operation.

A refrigeration cycle apparatus according to an embodiment of the present disclosure makes it possible to bring about improvement in reliability of a compressor without making an accumulator complex in structure.

DETAILED DESCRIPTION

In the following, refrigeration cycle apparatuses according to embodiments of the present disclosure are described with reference to the drawings. The present disclosure is not limited to the following embodiments, but may be variously changed without departing from the scope of the present disclosure. Further, the present disclosure encompasses all combinations of combinable ones of constituent elements shown in the following embodiments. Further, constituent elements given identical reference signs in each drawing are identical or equivalent to each other, and these reference signs are common throughout the full text of the description. Pieces of equipment or other devices of the same kind that are for example differentiated by subscripts such as A and B may be described with an omission of subscripts in a case in which they do not particularly need to be differentiated or identified. Furthermore, in each drawing, relative relationships in dimension between constituent elements, the shapes of the constituent elements, or other features of the constituent elements may be different from actual ones.

Embodiment 1

Figure 1:
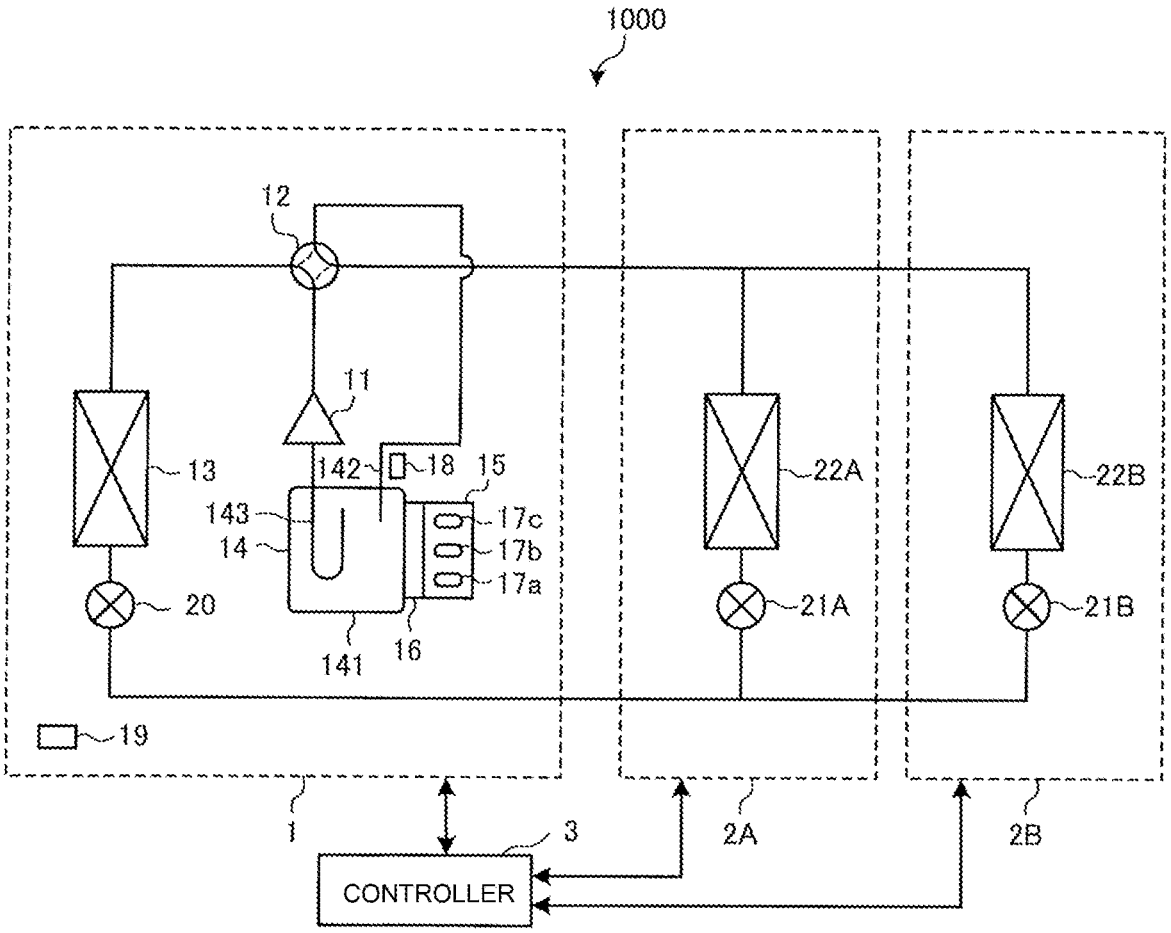
FIG. 1 is a schematic diagram showing a configuration of a refrigeration cycle apparatus according to Embodiment 1.

In the following, a refrigeration cycle apparatus according to Embodiment 1 is described. FIG. 1 is a schematic diagram showing a configuration of the refrigeration cycle apparatus according to Embodiment 1. FIG. 1 shows an air-conditioning apparatus 1000 as an example of the refrigeration cycle apparatus. As shown in FIG. 1, the air-conditioning apparatus 1000 includes an outdoor unit 1, two indoor units 2A and 2B, and a controller 3. The two indoor units 2A and 2B are connected in parallel to each other, and are identical in configuration to each other. The outdoor unit 1 and each of the indoor units 2A and 2B are connected by refrigerant pipes to form a refrigerant circuit. Although, in the example shown in FIG. 1, two indoor units 2A and 2B are connected to one outdoor unit 1, this is not intended to impose any limitation, and one indoor unit 2 or three or more indoor units 2 may be connected. Further, a plurality of outdoor units 1 may be connected.

The air-conditioning apparatus 1000 according to Embodiment 1 includes a liquid-level sensing device 15. During start-up of heating or during return to heating after completion of defrosting operation of the air-conditioning apparatus 1000, the liquid-level sensing device 15 senses the position of a liquid surface of refrigerant stored in an accumulator 14 installed in the outdoor unit 1. A state in which the position of the liquid surface is higher than a preset threshold Th is hereinafter referred to as a state in which "the liquid level is higher than the threshold Th". A state in which the liquid level in the accumulator 14 is higher than the threshold Th means that the amount of refrigerant that is contained in the refrigerant circuit excluding the accumulator 14 is small. In this case, there is an increase in gas flow rate of refrigerant flowing through the refrigerant circuit, so that the compressor 11 easily sucks low-pressure gas refrigerant. As a result, there is a possibility that there may occur liquid return from the accumulator 14 to the compressor 11. When liquid return occurs, liquid refrigerant accumulates at the bottom of the compressor 11, so that there is a deterioration of start-up characteristics during heating. For this reason, in Embodiment 1, in a case in which the liquid level in the accumulator 14 is higher than the threshold Th, the controller 3 performs a limiting operation of reducing the amount of suction of refrigerant that is sucked from the accumulator 14 into the compressor 11. Specifically, the controller 3 makes the frequency of the compressor 11 installed in the outdoor unit 1 lower than or equal to a preset first specified value Sp1. This makes it possible to reduce the occurrence of liquid return to the compressor 11, making it possible to bring about improvement in start-up characteristics of the air-conditioning apparatus 1000 for heating. In the following, the air-conditioning apparatus 1000 according to Embodiment 1 is described in detail.

[Configuration of Air-Conditioning Apparatus 1000]

(Outdoor Unit 1)

The outdoor unit 1 is installed outdoors. The outdoor unit 1 includes the compressor 11, a refrigerant flow switching device 12, an outdoor heat exchanger 13, the accumulator 14, and an expansion device 20.

The compressor 11 sucks in low-pressure gas refrigerant, compresses the gas refrigerant thus sucked in, and discharges resultant high-temperature and high-pressure gas refrigerant. Examples of the compressor 11 include an inverter compressor whose frequency is varied and whose capacity, which is an amount of refrigerant that is sent out per unit time, is thus controlled. The frequency of the compressor 11 is controlled by the controller 3.

The refrigerant flow switching device 12 is for example a four-way valve, and performs switching between cooling operation and heating operation by switching the directions in which refrigerant flows. During cooling operation, the refrigerant flow switching device 12 switches such that a discharge side of the compressor 11 is connected to the outdoor heat exchanger 13 as indicated by a solid line in FIG. 1. Further, during heating operation, the refrigerant flow switching device 12 switches such that the discharge side of the compressor 11 is connected to indoor heat exchangers 22A and 22B of the indoor units 2A and 2B as indicated by a dashed line in FIG. 1. Switching between flow passages in the refrigerant flow switching device 12 is controlled by the controller 3.

The outdoor heat exchanger 13 exchanges heat between outdoor air supplied by a fan (not illustrated) or other devices and refrigerant flowing through the refrigerant circuit. The outdoor heat exchanger 13 is a first heat exchanger. During cooling operation, the outdoor heat exchanger 13 operates as a condenser formed to condense the refrigerant by transferring the heat of the refrigerant to the outdoor air. Further, during heating operation, the outdoor heat exchanger 13 operates as an evaporator formed to evaporate the refrigerant and cool the outdoor air by the heat of vaporization.

The accumulator 14 is provided on a low-pressure side that is a suction side of the compressor 11. The accumulator 14 includes a hermetic container 141, an inlet pipe 142 through which refrigerant is introduced into the hermetic container 141, and a U-shaped outlet pipe 143 through which gas refrigerant is delivered from inside.

The accumulator 14 is formed such that excess refrigerant produced by a difference in operating condition between cooling operation and heating operation or excess refrigerant produced by a transient change in operation is introduced through the inlet pipe 142 into the hermetic container 141. In the hermetic container 141 of the accumulator 14, the excess refrigerant thus introduced is separated into gas refrigerant and liquid refrigerant. The gas refrigerant thus separated is sucked from the accumulator 14 via the outlet pipe 143 into the compressor 11. Meanwhile, the liquid refrigerant thus separated is stored in the accumulator 14. The liquid refrigerant thus separated either is sucked in small amounts into the compressor 11 through an oil return hole 143*a* or evaporates and gasifies with the passage of time and is sucked into the compressor 11.

The expansion device 20 has a variable opening degree and adjusts the flow rate of refrigerant. The expansion device 20 is connected between the outdoor heat exchanger 13 and the indoor heat exchangers 22A and 22B. The expansion device 20 is, for example, a valve, such as an electronic expansion valve, whose opening degree is controllable. The opening degree of the expansion device 20 is controlled by the controller 3. The expansion device 20 is a first expansion device.

Further, the outdoor unit 1 includes a refrigerant temperature sensor 18 and an outside air temperature sensor 19. The refrigerant temperature sensor 18 is provided at a refrigerant inlet of the accumulator 14 and senses the temperature of refrigerant flowing into the accumulator 14. The outside air temperature sensor 19 senses the temperature of outside air.

(Indoor Unit 2A)

The indoor unit 2A is installed indoors. The indoor unit 2A includes an expansion device 21A and the indoor heat exchanger 22A.

The expansion device 21A has a variable opening degree and adjusts the flow rate of refrigerant. The expansion device 21A is connected between the indoor heat exchanger 22A and the expansion device 20. The expansion device 21A is, for example, a valve, such as an electronic expansion valve, whose opening degree is controllable. The opening degree of the expansion device 21A is controlled by the controller 3.

The indoor heat exchanger 22A exchanges heat between air supplied by a fan (not illustrated) or other devices and refrigerant flowing through the refrigerant circuit. This produces heating air or cooling air that is supplied to an indoor space. The indoor heat exchanger 22A operates as an evaporator during cooling operation to perform cooling by cooling air in an air-conditioned space. Further, the indoor heat exchanger 22A operates as a condenser during heating operation to perform heating by heating air in an air-conditioned space.

(Indoor Unit 2B)

The indoor unit 2B is installed indoors. The indoor unit 2B includes an expansion device 21B and the indoor heat exchanger 22B.

The expansion device 21B has a variable opening degree and adjusts the flow rate of refrigerant. The expansion device 21B is connected between the indoor heat exchanger 22B and the expansion device 20. The expansion device 21B is, for example, a valve, such as an electronic expansion valve, whose opening degree is controllable. The opening degree of the expansion device 21B is controlled by the controller 3.

The indoor heat exchanger 22B exchanges heat between air supplied by a fan (not illustrated) or other devices and refrigerant flowing through the refrigerant circuit. This produces heating air or cooling air that is supplied to an indoor space. The indoor heat exchanger 22B operates as an evaporator during cooling operation to perform cooling by cooling air in an air-conditioned space. Further, the indoor heat exchanger 22B operates as a condenser during heating operation to perform heating by heating air in an air-conditioned space.

The expansion devices 21A and 21B are each a second expansion device.

Further, the indoor heat exchangers 22A and 22B are each a second heat exchanger.

Further, the accumulator 14, the compressor 11, the outdoor heat exchanger 13, the expansion device 20, the expansion devices 21A and 21B, and the indoor heat exchangers 22A and 22B are connected by the refrigerant pipes to form the refrigerant circuit, through which refrigerant circulates.

(Controller 3)

The controller 3 exercises overall control of the outdoor unit 1 and the indoor units 2A and 2B. Further, the controller 3 controls the frequency of the compressor 11 on the basis of a result of sensing of the liquid surface of refrigerant in the accumulator 14. The controller 3 has an arithmetic device such as a microcomputer, and achieves various functions by executing software such as a program stored in a memory. Alternatively, the controller 3 is dedicated hardware, such as a circuit device, that achieves various functions. Although, in FIG. 1, the controller 3 is provided outside the outdoor unit 1 and the indoor units 2A and 2B, this is not intended to impose any limitation, and the controller 3 may be provided inside any of the outdoor unit 1 and the indoor units 2A and 2B.

In Embodiment 1, as mentioned above, the accumulator 14 is provided with the liquid-level sensing device 15 configured to sense the position of the liquid surface of refrigerant stored in the accumulator 14. The liquid-level sensing device 15 includes heaters 16 and a plurality of temperature sensors 17*a* to 17*c*. In this example, three temperature sensors 17*a* to 17*c* are provided. However, this is not intended to limit the number of temperature sensors. That is, two or more temperature sensors need only be provided, as the liquid-level sensing device 15 needs only be able to sense the position of a liquid surface in the hermetic container 141 of the accumulator 14 on a scale of one to two or more.

Under control of the controller 3, the heaters 16 heat a surface of the accumulator 14 uniformly in a height direction of the accumulator 14. The height direction of the accumulator 14 is hereinafter referred to as "Z direction". The plurality of temperature sensors 17*a* to 17*c* are disposed at different heights of the accumulator 14, and sense surface temperatures of the accumulator 14 at the heights at which they are disposed. The temperature sensor 17*a* senses a surface temperature Ta of a lower part of the accumulator 14. The temperature sensor 17*b* senses a surface temperature Tb of a middle part of the accumulator 14. The temperature sensor 17*c* senses a surface temperature Tc of an upper part of the accumulator 14.

The controller 3 controls, on the basis of temperatures sensed by the temperature sensors 17*a* to 17*c* of the liquid-level sensing device 15, the refrigerant temperature sensor 18, the outside air temperature sensor 19, or other sensors, a liquid-level sensing operation that is performed by the liquid-level sensing device 15. Further, the controller 3 determines the liquid level in the accumulator 14 on the basis of a result of the liquid-level sensing. Furthermore, the controller 3 controls the frequency of the compressor 11 on the basis of the liquid level in the accumulator 14.

Figure 2:
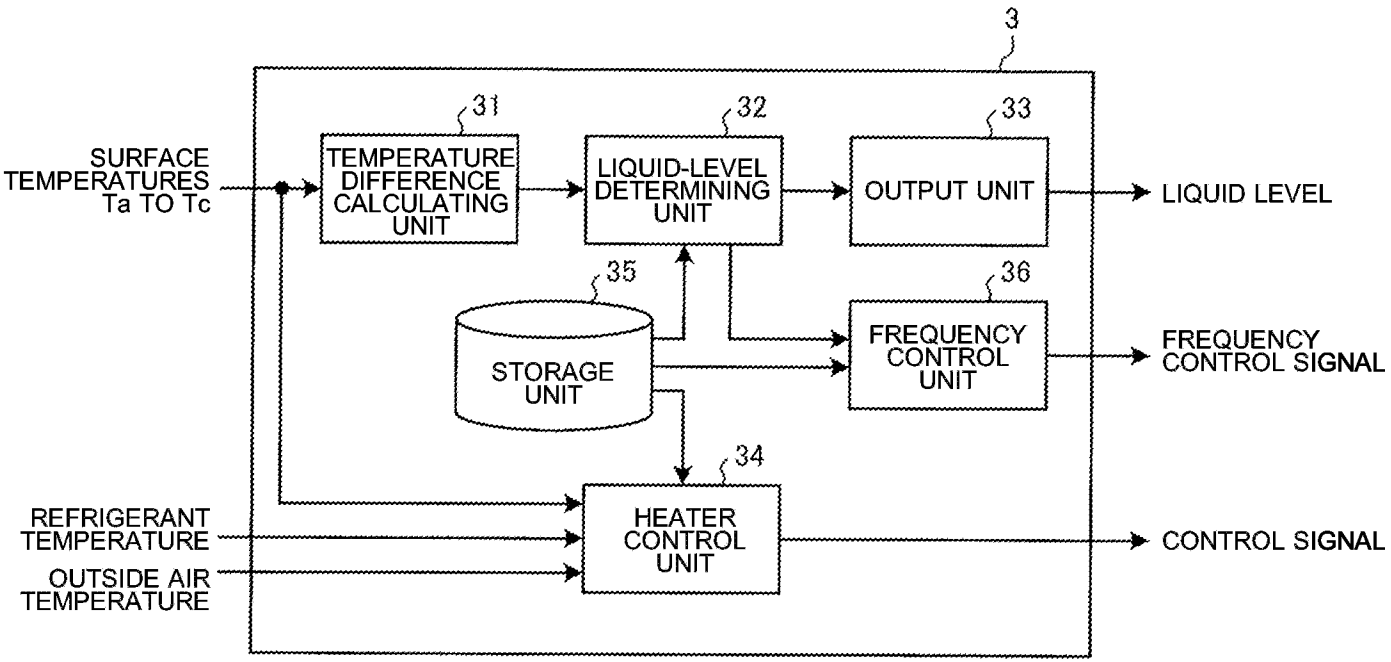
FIG. 2 is a block diagram showing a configuration of a controller of an air-conditioning apparatus according to Embodiment 1.

FIG. 2 is a block diagram showing a configuration of the controller 3 of an air-conditioning apparatus 1000 according to Embodiment 1. As shown in FIG. 2, the controller 3 includes a temperature difference calculating unit 31, a liquid-level determining unit 32, an output unit 33, a heater control unit 34, a storage unit 35, and a frequency control unit 36.

The temperature difference calculating unit 31 calculates a temperature difference $\Delta T_{high}$ by subtracting the surface temperature Ta of the accumulator 14 as sensed by the temperature sensor 17*a* from the surface temperature Tc of the accumulator 14 as sensed by the temperature sensor 17*c*. Further, the temperature difference calculating unit 31 calculates a temperature difference $\Delta T_{middle}$ by subtracting the surface temperature Ta of the accumulator 14 as sensed by the temperature sensor 17*a* from the surface temperature Tb of the accumulator 14 as sensed by the temperature sensor 17*b*.

The liquid-level determining unit 32 reads out a set value T1 stored in the storage unit 35 and compares the set value T1 with the temperature differences $\Delta T_{high}$ and $\Delta T_{middle}$ calculated by the temperature difference calculating unit 31. Moreover, the liquid-level determining unit 32 determines, on the basis of a result of the comparison, the position of a liquid surface of liquid refrigerant in the accumulator 14.

The output unit 33 outputs information regarding the liquid level in the accumulator 14 on the basis of a result of the determination made by the liquid-level determining unit 32. Usable examples of the output unit 33 include a display, a light-emitting diode (LED), and a speaker. In a case in which the output unit 33 is a display, the information regarding the liquid level is displayed, for example, as characters or figures. In a case in which the output unit 33 is an LED, the information regarding the liquid level is displayed, for example, such that the LED is turned on, blinks, and is turned off. In a case in which the output unit 33 is a speaker, the information regarding the liquid level is notified by sounds.

The heater control unit 34 controls the turning on and turning off of the heaters 16 on the basis of various temperatures sensed by the temperature sensors 17*a* to 17*c*, the refrigerant temperature sensor 18, and the outside air temperature sensor 19. The heater control unit 34 sends the heaters 16 a control signal for controlling the turning on and turning off of the heaters 16.

The storage unit 35 stores in its inside various types of information that are used in performing a process in each unit of the controller 3. The storage unit 35 has stored in advance in its inside the set value T1, which is used by the liquid-level determining unit 32. Further, the storage unit 35 has stored in its inside set temperatures T2, T3, and T4 that are used by the heater control unit 34.

The frequency control unit 36 determines, on the basis of a result of the determination made by the liquid-level determining unit 32, the frequency of the compressor 11 with reference to frequency information stored in the storage unit 35. The frequency control unit 36 sends the compressor 11 a frequency control signal for controlling the frequency of the compressor 11.

[Structure of Liquid-Level Sensing Device 15]

Figure 3:
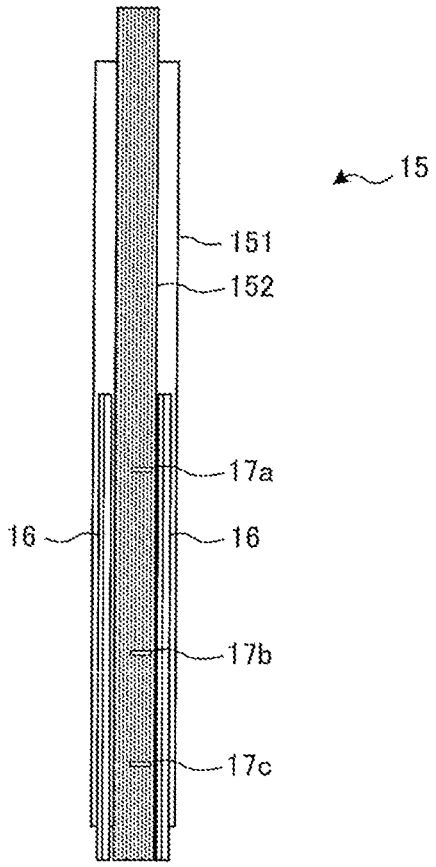
FIG. 3 is a plan view showing an example of a structure of a liquid-level sensing device of FIG. 1.

A structure of the liquid-level sensing device 15 is described. FIG. 3 is a plan view showing an example of a structure of the liquid-level sensing device 15 of FIG. 1. As shown in FIG. 3, the liquid-level sensing device 15 includes a belt unit 151, a heat insulating material 152, the heaters 16, and the temperature sensors 17*a* to 17*c*.

The belt unit 151 is formed by a metallic component such as an elongated aluminum tape. The belt unit 151 has a length corresponding to the shape and size of the accumulator 14 to which it is attached, and is wound around the accumulator 14 in the height direction of the accumulator 14, that is, the Z direction.

The heat insulating material 152 is provided on a surface of the belt unit 151. The heat insulating material 152 is formed to extend in a length direction of the belt unit 151. The heaters 16 are provided on the surface of the belt unit 151. The heaters 16 are for example bendable belt heaters, and are provided along both widthwise ends of the heat insulating material 152.

The length of each of the heaters 16 may be shorter than the entire length of the belt unit 151 in the length direction of the belt unit 151, and is determined to correspond to the size of the accumulator 14. For example, it is preferable that the length of each of the heaters 16 be about equal to the entire length of the accumulator 14 in the height direction of the accumulator 14, that is, the Z direction with the liquid-level sensing device 15 attached to the accumulator 14. It is not always the case that the plurality of heaters 16 are provided. For example, only one heater 16 may be provided, as long as the accumulator 14 is sufficiently heated.

The temperature sensors 17*a* to 17*c* are provided on the heat insulating material 152. That is, in a case in which the liquid-level sensing device 15 is provided with the plurality of heaters 16, the temperature sensors 17*a* to 17*c* are provided between the plurality of heaters 16. The temperature sensors 17*a* to 17*c* are sequentially arranged in different positions in the height direction of the accumulator 14, that is, the Z direction. The respective locations of the temperature sensors 17*a* to 17*c* are determined to correspond to the heights at which they sense the surface temperatures of the accumulator 14 with the liquid-level sensing device 15 attached to the accumulator 14.

A purpose for which the heaters 16 are thus provided at both widthwise ends of the heat insulating material 152 and on the accumulator 14 in the height direction of the accumulator 14, that is, the Z direction is to heat the accumulator 14 evenly along the height of the accumulator 14 when the accumulator 14 is heated by the heaters 16. Further, a purpose for which the temperature sensors 17*a* to 17*c* are provided on the heat insulating material 152 is to prevent, for example, the heat of the heaters 16 and external heat from being transmitted to the temperature sensors 17*a* to 17*c* when the surface temperatures of the accumulator 14 are sensed by the temperature sensors 17*a* to 17*c*. Furthermore, a purpose for which the temperature sensors 17*a* to 17*c* are provided between the plurality of heaters 16 is to accurately sense the surface temperatures of the accumulator 14.

Figure 4:
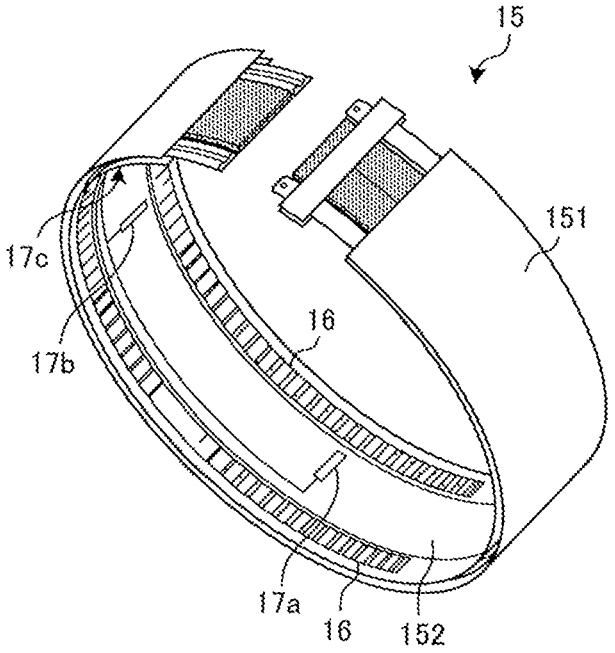
FIG. 4 is a schematic view for explaining a shape of the liquid-level sensing device of FIG. 3 to be attached to an accumulator.

FIG. 4 is a schematic view for explaining a shape of the liquid-level sensing device 15 of FIG. 3 to be attached to the accumulator 14. In the liquid-level sensing device 15 shown in FIG. 3, the belt unit 151 and the heaters 16 are bendable. This makes it possible to bend the liquid-level sensing device 15 to correspond to the shape of the accumulator 14 as shown in FIG. 4.

[Attachment of Liquid-Level Sensing Device 15]

Figure 5:
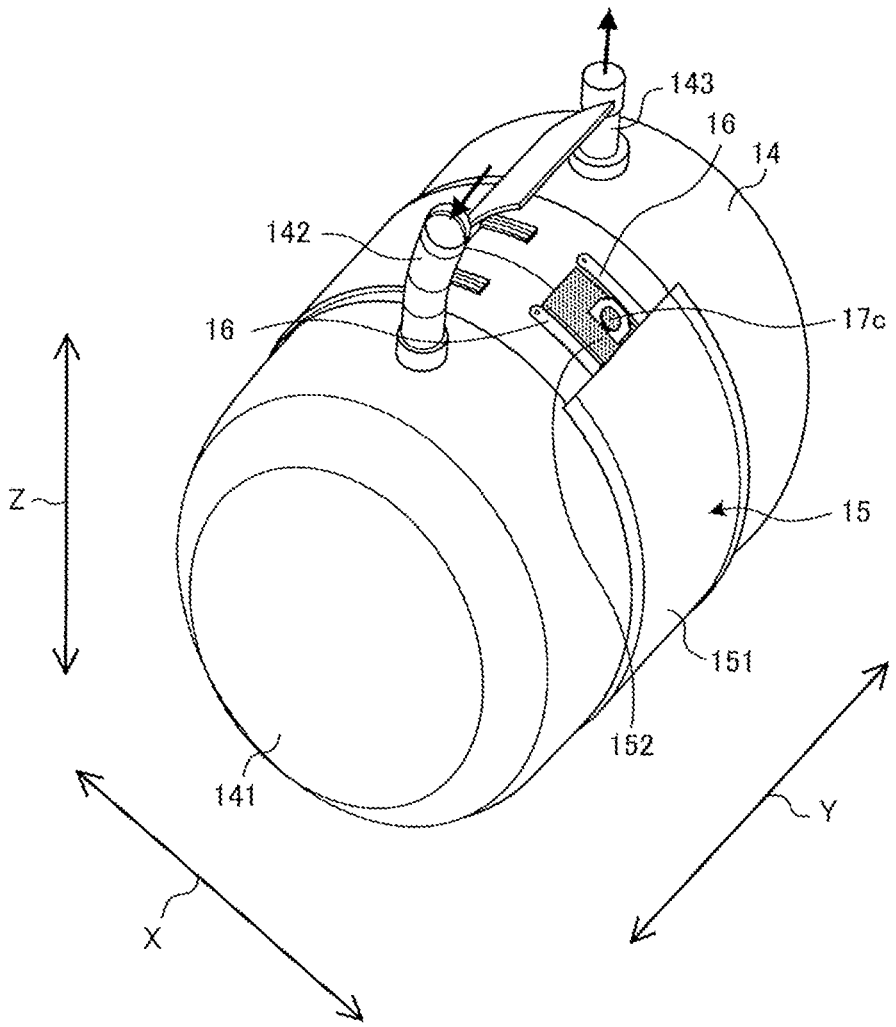
FIG. 5 is a perspective view showing a state in which the liquid-level sensing device of FIG. 3 is attached to the accumulator.

FIG. 5 is a perspective view showing a state in which the liquid-level sensing device 15 of FIG. 3 is attached to the accumulator 14. As shown in FIG. 5, the liquid-level sensing device 15 is attached to the accumulator 14 such that the liquid-level sensing device 15 is wound around the accumulator 14 and the length direction of the belt unit 151 corresponds to the Z direction. In FIG. 5, a width direction of the accumulator 14 is referred to as "Y direction", and a depth direction of the accumulator 14 is referred to as "X direction".

At this time, the belt unit 151 is bent such that an upper surface of the belt unit 151 on which the heaters 16 and the temperature sensors 17*a* to 17*c* are provided is an inner circumferential surface. Then, the liquid-level sensing device 15 is attached such that the heaters 16 and the temperature sensors 17*a* to 17*c* make contact with the surface of the accumulator 14.

Figure 6:
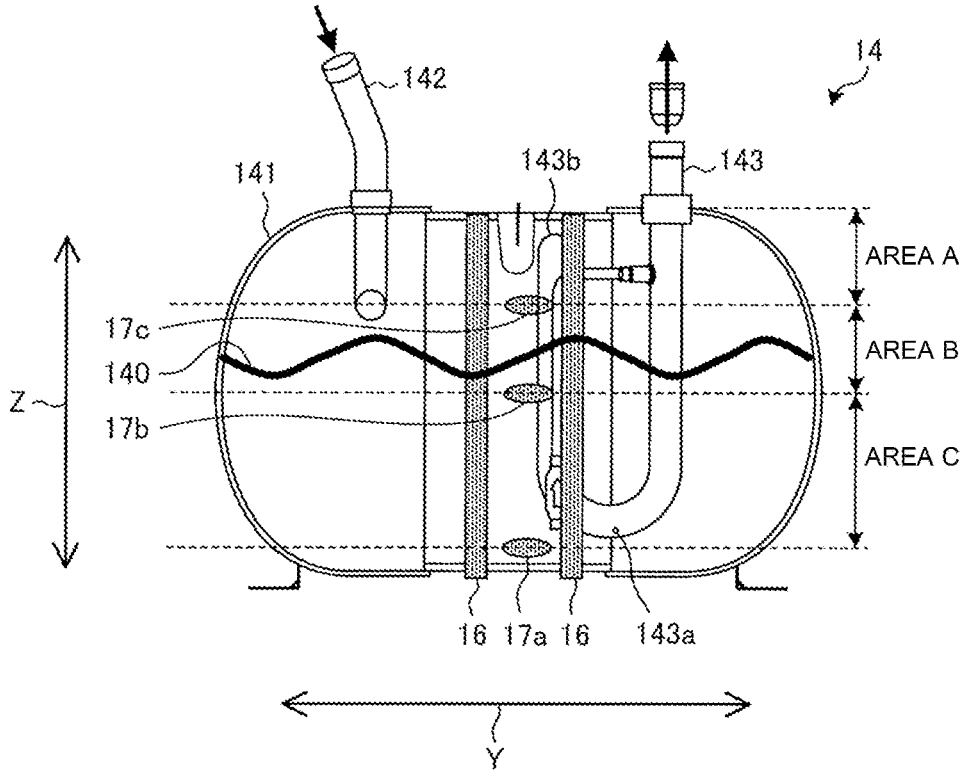
FIG. 6 is a cross-sectional view schematically showing the state in which the liquid-level sensing device of FIG. 3 is attached to the accumulator.

FIG. 6 is a cross-sectional view schematically showing the state in which the liquid-level sensing device 15 of FIG. 3 is attached to the accumulator 14. As shown in FIG. 6, the liquid-level sensing device 15 is attached to the accumulator 14 such that the temperature sensors 17*a* to 17*c* are located at the predetermined heights. In FIG. 6, the Z direction and the Y direction correspond to the Z direction and the Y direction of FIG. 5, respectively.

In the example shown in FIG. 6, the accumulator 14 includes a hermetic container 141, an inlet pipe 142 through which refrigerant is introduced into the hermetic container 141, and a U-shaped outlet pipe 143 through which gas refrigerant is supplied from inside to the compressor 11. The outlet pipe 143 has an oil return hole 143*a* through which liquid refrigerant flows in and a gas suction opening 143*b* through which gas refrigerant is sucked in.

In the accumulator 14, excess refrigerant introduced into the hermetic container 141 through the inlet pipe 142 is separated into gas refrigerant and liquid refrigerant. The gas refrigerant thus separated is sucked from the accumulator 14 via the gas suction opening 143*b* and the outlet pipe 143 into the compressor 11. Meanwhile, the liquid refrigerant thus separated is stored in the accumulator 14. The liquid refrigerant thus separated either is sucked in small amounts into the compressor 11 through the oil return hole 143*a* or evaporates and gasifies with the passage of time and is sucked in through the gas suction opening 143*b* and sucked into the compressor 11.

In particular, the temperature sensor 17*a* is in a place where it is allowed to sense the surface temperature of the lower part of the accumulator 14. Specifically, the temperature sensor 17*a*, which is provided in the lowermost part, is located below the oil return hole 143*a* of the outlet pipe 143 of the accumulator 14. This is intended for the temperature sensor 17*a* to be allowed to sense the surface temperature of the accumulator 14 in a place where liquid refrigerant is surely present.

Further, the temperature sensor 17*c* is in a place where it is allowed to sense the surface temperature of the upper part of the accumulator 14. Specifically, the temperature sensor 17*c*, which is provided in the uppermost part, is located below the gas suction opening 143*b* of the outlet pipe 143 of the accumulator 14. This is intended to prevent a liquid surface 140 of liquid refrigerant from reaching an upper side of the gas suction opening 143*b* during liquid-level sensing.

The temperature sensor 17*b* may be in a place at any height between the temperature sensor 17*a* and the temperature sensor 17*c*. Specifically, it is preferable that the temperature sensor 17*b* be in a place where the liquid surface 140 is desired to be sensed.

In a case in which the temperature sensors 17*a* to 17*c* are positioned as noted above, an area from an upper surface of the accumulator 14 to the temperature sensor 17*c* is hereinafter referred to as "area A". Further, an area from the temperature sensor 17*c* to the temperature sensor 17*b* is referred to as "area B", and an area from the temperature sensor 17*b* to the temperature sensor 17*a* is referred to as "area C". It should be noted that an area from the temperature sensor 17*a* to the bottom is an area in which liquid refrigerant is surely present. A reason for this is that the temperature sensor 17*a* is located below the oil return hole 143*a* and liquid refrigerant stored below the oil return hole 143*a* remains without being sucked into the outlet pipe 143. In Embodiment 1, the threshold Th is defined to be a boundary between the area A and the area B. That is, the threshold Th is defined to be a height position of the temperature sensor 17*c*, that is, an installation position of the temperature sensor 17*c* in the Z direction.

[Liquid-Level Sensing Process]

Figure 7:
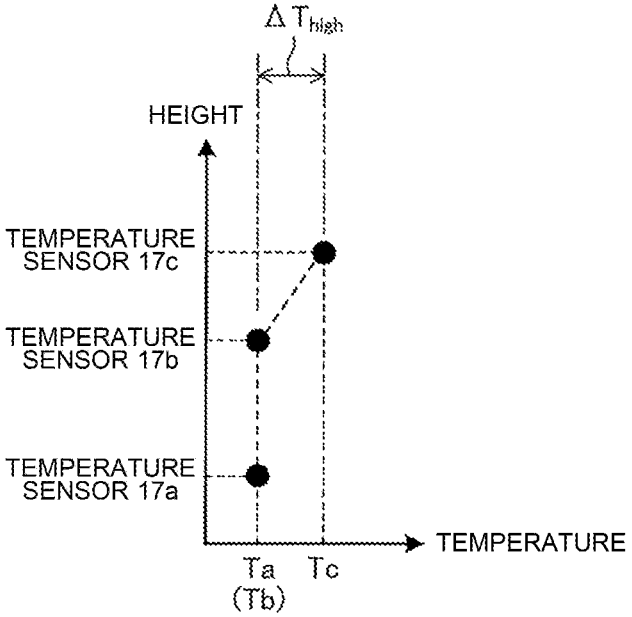
FIG. 7 is a diagram showing a graph for explaining a relationship between surface temperatures of the accumulator and the heights of temperature sensors.

A method for sensing the liquid surface 140 of liquid refrigerant in the accumulator 14 according to Embodiment 1 is described. FIG. 7 is a diagram showing a graph for explaining a relationship between the surface temperatures of the accumulator 14 and the heights of the temperature sensors 17*a* to 17*c*.

FIG. 7 shows surface temperatures in the respective positions of the temperature sensors 17*a* to 17*c* in a case in which the liquid surface 140 of liquid refrigerant in the accumulator 14 is present in the area B as shown in FIG. 6.

As shown in FIG. 7, there is a difference between the surface temperature of the accumulator 14 as sensed by the temperature sensor 17*c* located above the liquid surface 140 of liquid refrigerant present in the area B, and the surface temperature of the accumulator 14 as sensed by the temperature sensors 17*a* and 17*b* located below the liquid surface 140 of the liquid refrigerant. Specifically, the surface temperature Tc sensed by the temperature sensor 17*c* is higher than the surface temperature Ta sensed by the temperature sensor 17*a* and the surface temperature Tb sensed by the temperature sensor 17*b*. A reason for this is that the surface temperatures of the accumulator 14 having been heated vary as the thermal conductivity of liquid refrigerant and the thermal conductivity of gas are different.

In Embodiment 1, the controller 3 senses the liquid surface 140 in the accumulator 14 on the basis of the surface temperatures Ta to Tc of the accumulator 14 having been heated as sensed by the temperature sensors 17*a* to 17*c* of the liquid-level sensing device 15.

In Embodiment 1, the temperature sensor 17*a* is provided in a place where liquid refrigerant is surely present. For this reason, as the temperature sensor 17*a* senses a surface temperature of the accumulator 14 in a liquid area where liquid refrigerant is always present, the temperature thus sensed is defined as a reference temperature.

As mentioned above, in a case in which the temperature sensors 17*b* and 17*c* are located below the liquid surface 140 of the liquid refrigerant and have sensed surface temperatures of the accumulator 14 in liquid areas, the surface temperatures sensed by the temperature sensors 17*b* and 17*c* are substantially equal to the surface temperature sensed by the temperature sensor 17*a*. On the other hand, in a case in which the temperature sensors 17*b* and 17*c* are located above the liquid surface 140 of the liquid refrigerant and have sensed surface temperatures of the accumulator 14 in a gas area, the surface temperatures sensed by the temperature sensors 17*b* and 17*c* are higher than the surface temperature sensed by the temperature sensor 17*a*.

That is, it is possible to, by separately calculating a temperature difference between each of the surface temperatures sensed by the temperature sensors 17*b* and 17*c* and the surface temperature sensed by the temperature sensor 17*a* and comparing the temperature difference with the preset set value T1, determine in which of the areas A to C the liquid surface 140 is present. Specifically, in a case in which the temperature difference between the surface temperature sensed by the temperature sensor 17*b* and the surface temperature sensed by the temperature sensor 17*a* is greater than or equal to the set value T1, the position of the liquid surface 140 is determined to be present in an area below the temperature sensor 17*b*. Similarly, in a case in which the temperature difference between the surface temperature sensed by the temperature sensor 17*c* and the surface temperature sensed by the temperature sensor 17*a* is greater than or equal to the set value T1, the position of the liquid surface 140 is determined to be present in an area below the temperature sensor 17*c*.

It should be noted that temperature differences between a surface temperature of the accumulator 14 in a liquid area and a surface temperature of the accumulator 14 in a gas area vary depending on the heating capacity or other characteristics of the heaters 16 configured to heat the accumulator 14. Therefore, a set value serving as a threshold is determined in advance to correspond to the heating capacity or other characteristics of the heaters 16.

The liquid-level sensing process is performed after the accumulator 14 has been heated by turning on the heaters 16. When the heaters 16 are turned on, the safety of the air-conditioning apparatus 1000 is considered.

In Embodiment 1, in a case in which the surface temperatures Ta to Tc of the accumulator 14 as sensed by the temperature sensors 17*a* to 17*c* are each lower than or equal to a set temperature T2, the heater control unit 34 controls the heaters 16 such that the heaters 16 are turned on. The set temperature T2 is a guaranteed outside air temperature at which the operation of the air-conditioning apparatus 1000 is guaranteed or a temperature that is slightly higher than the guaranteed outside air temperature, and is determined in advance. This is intended to prevent the liquid-level sensing process from being performed when an outside air temperature is a temperature at which the operation of the air-conditioning apparatus 1000 is not guaranteed.

Further, in a case in which a temperature difference between the surface temperature sensed by the temperature sensor 17*a* and the temperature of refrigerant at the inlet of the accumulator 14 as sensed by the refrigerant temperature sensor 18 is less than or equal to a set temperature T3, the heater control unit 34 controls the heaters 16 such that the heaters 16 are turned on. The set temperature T3 is set such that liquid refrigerant stored in the accumulator 14 does not evaporate. This is intended to prevent liquid refrigerant in the accumulator 14 from evaporating into gas refrigerant when the accumulator 14 is heated by the heaters 16.

Furthermore, in a case in which the outside air temperature sensed by the outside air temperature sensor 19 is lower than or equal to a preset set temperature T4, the heater control unit 34 may control the heaters 16 such that the heaters 16 are turned on. Further, the control of the turning on and turning off of the heaters 16 is not limited to such a case in which safety is considered, but for example, the turning on and turning off may be repeated every set period of time.

Figure 8:
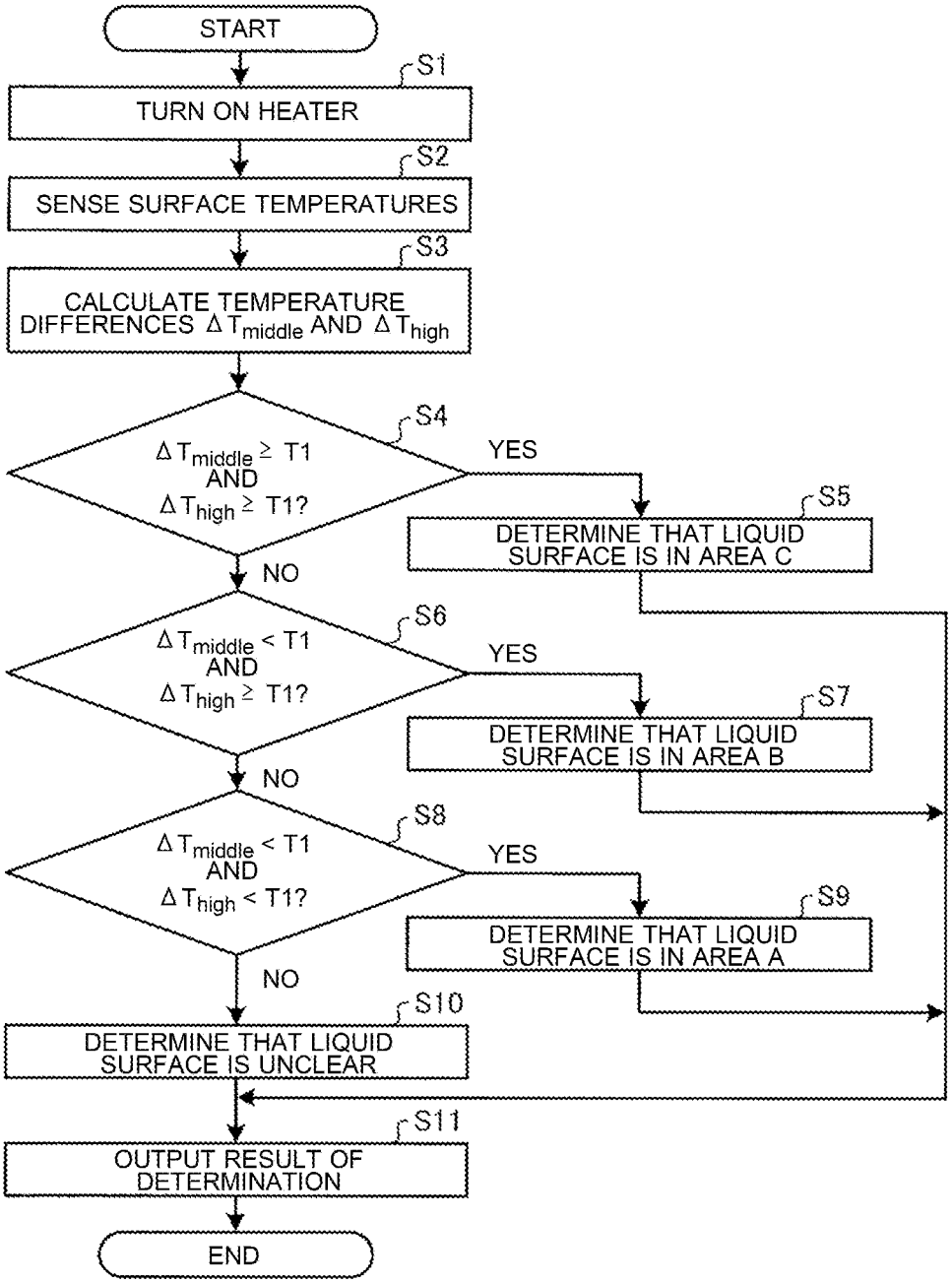
FIG. 8 is a flow chart showing an example of a sequence of actions making up a liquid-level sensing process in the air-conditioning apparatus according to Embodiment 1.

FIG. 8 is a flow chart showing an example of a sequence of actions making up a liquid-level sensing process in the air-conditioning apparatus 1000 according to Embodiment 1.

In step S1, the heater control unit 34 controls the heaters 16 such that the heaters 16 are turned on. Consequently, the accumulator 14 is heated.

In step S2, after the set period of time has elapsed after the heaters 16 are turned on, the temperature sensors 17*a* to 17*c* sense the respective surface temperatures Ta to Tc of the accumulator 14.

In step S3, the temperature difference calculating unit 31 calculates the temperature difference $\Delta T_{middle}$ and the temperature difference $\Delta T_{high}$ on the basis of the surface temperatures Ta to Tc sensed by the temperature sensors 17*a* to 17*c*. The temperature difference $\Delta T_{middle}$ between the surface temperature Tb sensed by the temperature sensor 17*b* and the surface temperature Ta sensed as a reference temperature by the temperature sensor 17*a* is calculated on the basis of Formula (1). Further, the temperature difference $\Delta T_{high}$ between the surface temperature Tc sensed by the temperature sensor 17*c* and the surface temperature Ta sensed by the temperature sensor 17*a* is calculated on the basis of Formula (2).

$$\text{Temperature Difference } \Delta T_{middle} = Tb - Ta \quad (1)$$

$$\text{Temperature Difference } \Delta T_{high} = Tc - Ta \quad (2)$$

Next, the liquid-level determining unit 32 reads out the set value T1 from the storage unit 35 for the temperature difference $\Delta T_{middle}$ and the temperature difference $\Delta T_{high}$. Then, the liquid-level determining unit 32 compares, with each of the temperature differences $\Delta T_{middle}$ and $\Delta T_{high}$ calculated in step S3, the set value T1 read out from the storage unit 35.

In step S4, the liquid-level determining unit 32 determines whether the temperature difference $\Delta T_{middle}$ is greater than or equal to the set value T1 and the temperature difference $\Delta T_{high}$ is greater than or equal to the set value T1. Positive determination on the basis of these criteria means that the temperature sensor 17*b* and the temperature sensor 17*c* are located in gas areas, where no liquid refrigerant is present.

In the case of YES in step S4, the liquid-level determining unit 32 proceeds to step S5, in which the liquid-level determining unit 32 determines that the area A and the area B are gas areas and the liquid surface 140 is present in the area C. On the other hand, in the case of NO in step S4, the process shifts to step S6.

In step S6, the liquid-level determining unit 32 determines whether the temperature difference $\Delta T_{high}$ is greater than or equal to the set value T1 and the temperature difference $\Delta T_{middle}$ is less than the set value T1. Positive determination on the basis of these criteria means that the temperature sensor 17*b* is located in a gas area and the temperature sensor 17*c* is located in a liquid area, where liquid refrigerant is present.

In the case of YES in step S6, the liquid-level determining unit 32 proceeds to step S7, in which the liquid-level determining unit 32 determines that the area A is a gas area and the liquid surface 140 of liquid refrigerant is present in the area B. On the other hand, in the case of NO in step S6, the process shifts to step S8.

In step S8, the liquid-level determining unit 32 determines whether the temperature difference $\Delta T_{high}$ is less than the set value T1 and the temperature difference $\Delta T_{middle}$ is less than the set value T1. Positive determination on the basis of these criteria means that the temperature sensor 17*b* and the temperature sensor 17*c* are located in liquid areas.

In the case of YES in step S8, the liquid-level determining unit 32 proceeds to step S9, in which the liquid-level determining unit 32 determines that the liquid surface 140 of liquid refrigerant is present in the area A. On the other hand, in the case of NO in step S8, the liquid-level determining unit 32 proceeds to step S10, in which the liquid-level determining unit 32 determines that it is unclear in which area the liquid surface 140 of liquid refrigerant is present.

In step S11, the liquid-level determining unit 32 outputs a result of the determination made in step S5, S7, S9, or S10. In a case in which it has been determined as a result of step S5 that the liquid surface 140 of liquid refrigerant is present in the area C, the liquid-level determining unit 32 outputs a result that the liquid level is a level c. In a case in which it has been determined as a result of step S7 that the liquid surface 140 of liquid refrigerant is present in the area B, the liquid-level determining unit 32 outputs a result that the liquid level is a level b. In a case in which it has been determined as a result of step S9 that the liquid surface 140 of liquid refrigerant is present in the area A, the liquid-level determining unit 32 outputs a result that the liquid level is a level a. Further, in a case in which it has been determined in step S10 that it is unclear in which area the liquid surface 140 of liquid refrigerant is present, the liquid-level determining unit 32 outputs a result that the liquid level is unclear.

In Embodiment 1, as mentioned above, the liquid-level sensing method for performing liquid-level sensing with the liquid-level sensing device 15 has been described. However, this is merely an example and is not intended to impose any limitation. Examples of other liquid-level sensing methods include the following method, which is executed by the controller 3.

Temperature detecting devices such as thermistors are installed at the inlet and an outlet of the accumulator 14, and in a case in which a temperature difference between the temperature of refrigerant at the inlet of the accumulator 14 and the temperature of refrigerant at the outlet of the accumulator 14 is greater than a preset set value T5, the controller 3 determines that the liquid level is higher than the threshold Th. It should be noted that the refrigerant temperature sensor 18 may be used as a temperature detecting device at the inlet of the accumulator 14.

Alternatively, a pressure sensor and a thermistor may be installed on a high-pressure side of the compressor 11, and the controller 3 may be configured to calculate a degree of superheat of discharge from a detected pressure and a detected temperature and determine, on the basis of the degree of superheat of discharge, whether the liquid level is higher than the threshold Th or normal. It should be noted that the degree of superheat is a temperature difference between a superheated vapor temperature and a saturation temperature at a certain pressure. Thus, when the compressor 11 sucks in a small amount of gas refrigerant, the degree of superheat rises. On the other hand, when the compressor 11 sucks in a large amount of gas refrigerant, the degree of superheat drops. Therefore, when the degree of superheat is lower than a preset set value T6, it is determined that the liquid level is higher than the threshold Th.

Thus, even in a case in which no liquid-level sensing device 15 is provided, it is possible to sense the liquid level in the accumulator 14. It should be noted that an advantage of the use of the liquid-level sensing device 15 is that the liquid level is detected with high accuracy. On the other hand, an advantage of the omission of the liquid-level sensing device 15 is low cost.

Thus, the air-conditioning apparatus 1000 according to Embodiment 1 has the liquid-level sensing device 15. During start-up of heating or during return to heating after completion of defrosting operation of the air-conditioning apparatus 1000, the liquid-level sensing device 15 senses the liquid level in the accumulator 14 installed in the outdoor unit 1. In a case in which the liquid level in the accumulator 14 is higher than the preset threshold Th, the controller 3 makes the frequency of the compressor 11 installed in the outdoor unit 1 lower than or equal to the preset first specified value Sp1. This makes it possible to reduce the occurrence of liquid return from the accumulator 14 to the compressor 11, making it possible to bring about improvement in start-up characteristics of the air-conditioning apparatus 1000. The following describes how the controller 3 operates.

[Process of Controlling Frequency of Compressor 11]

Figure 9:
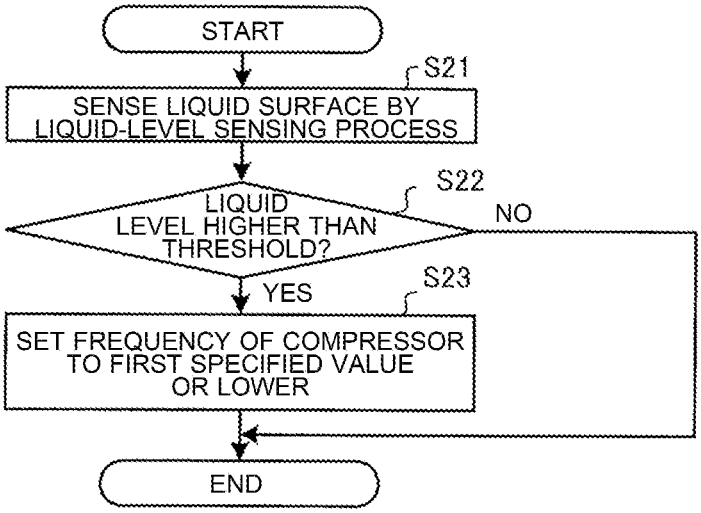
FIG. 9 is a flow chart showing a sequence of actions making up a frequency control process of the air-conditioning apparatus according to Embodiment 1.

FIG. 9 is a flow chart showing a sequence of actions making up a frequency control process of the air-conditioning apparatus 1000 according to Embodiment 1.

In step S21, the liquid level in the accumulator 14 is sensed by performing the process of the flow chart of FIG. 8 in a state in which the operation of the compressor 11 is stopped.

In step S22, the frequency control unit 36 of the controller 3 determines, on the basis of the liquid level sensed in step S21, whether the liquid level in the accumulator 14 is higher than the threshold Th. Specifically, in a case in which the liquid level in the accumulator 14 is the level a, the frequency control unit 36 determines that the liquid level in the accumulator 14 is higher than the threshold Th, and proceeds to step S23. On the other hand, in a case in which the liquid level in the accumulator 14 is the level b or the level c, the frequency control unit 36 determines that the liquid level is normal, and ends the process of FIG. 9.

In step S23, the frequency control unit 36 of the controller 3 sets the frequency of the compressor 11 to the preset first specified value Sp1 or lower.

Thus, in Embodiment 1, the frequency control unit 36 controls the frequency of the compressor 11 on the basis of the liquid level in the accumulator 14 as sensed by the liquid-level determining unit 32. Specifically, in a case in which the liquid level in the accumulator 14 is higher than the threshold Th, the frequency control unit 36 sets the frequency of the compressor 11 to the first specified value Sp1 or lower. This makes it possible to reduce the occurrence of liquid return from the accumulator 14 to the compressor 11 upon start-up of the compressor 11. As a result, this makes it possible to bring about improvement in start-up characteristics of the air-conditioning apparatus 1000 during start-up of heating or during return to heating after completion of defrosting operation of the air-conditioning apparatus 1000.

On the other hand, in a case in which the liquid level in the accumulator 14 is determined to be normal, the frequency control unit 36 controls the frequency of the compressor 11 by a control method for normal operation. That is, the frequency control unit 36 controls the frequency of the compressor 11 such that a target condensing temperature or a target discharge temperature is achieved.

In Embodiment 1, as noted above, during start-up of heating or during return to heating after completion of defrosting operation of the air-conditioning apparatus 1000, the liquid-level sensing device 15 senses the liquid level in the accumulator 14 installed in the outdoor unit 1. In a case in which the liquid level in the accumulator 14 is higher than the threshold Th, the controller 3 makes the frequency of the compressor 11 installed in the outdoor unit 1 lower than or equal to the preset first specified value Sp1. This inhibits the rise in gas flow rate of refrigerant flowing through the refrigerant circuit, making it possible to reduce the suction of low-pressure refrigerant into the compressor 11. As a result, this makes it possible to reduce the occurrence of liquid return from the accumulator 14 to the compressor 11, making it possible to bring about improvement in start-up characteristics of the air-conditioning apparatus 1000 for heating. This also makes it possible to bring about improvement in reliability of the compressor 11 without making the accumulator 14 complex in structure.

Modification of Embodiment 1

In a modification of Embodiment 1, the frequency control unit 36 sets the frequency of the compressor 11 to the first specified value Sp1 or lower in step S23 of FIG. 9 and then determines an amount of increase in the frequency of the compressor 11 to correspond to an amount of change in the liquid level in the accumulator 14.

Specifically, the liquid-level sensing process of FIG. 8 is performed twice or more. The frequency control unit 36 calculates a difference between the previous liquid level and the latest liquid level. The difference serves as the amount of change in the liquid level in the accumulator 14. The storage unit 35 has stored in its inside a table on which amounts of increase in the frequency of the compressor 11 are predetermined for respective amounts of change in liquid level. The frequency control unit 36 refers to the table and determines an amount of increase in the frequency of the compressor 11 on the basis of the amount of change in the liquid level in the accumulator 14. This makes it possible to gradually increase the frequency of the compressor 11 to correspond to the amount of change in liquid level.

In Embodiment 1, the liquid-level sensing device 15 has three temperature sensors 17 such that there are three categories of liquid levels. However, in the modification of Embodiment 1, the liquid-level sensing device 15 may have four or more temperature sensors 17. In this case, it is possible to more finely sense amounts of change in liquid level.

In the modification of Embodiment 1, as noted above, the frequency control unit 36 determines an amount of increase in the frequency of the compressor 11 to correspond to an amount of change in the liquid level in the accumulator 14. This makes it possible to increase the frequency of the compressor 11 while reducing the suction of low-pressure refrigerant into the compressor 11, thus making it possible to bring about further improvement in start-up characteristics of the air-conditioning apparatus 1000 than that of Embodiment 1. This also makes it possible to bring about improvement in reliability of the compressor 11 without making the accumulator 14 complex in structure.

Embodiment 2

Figure 10:
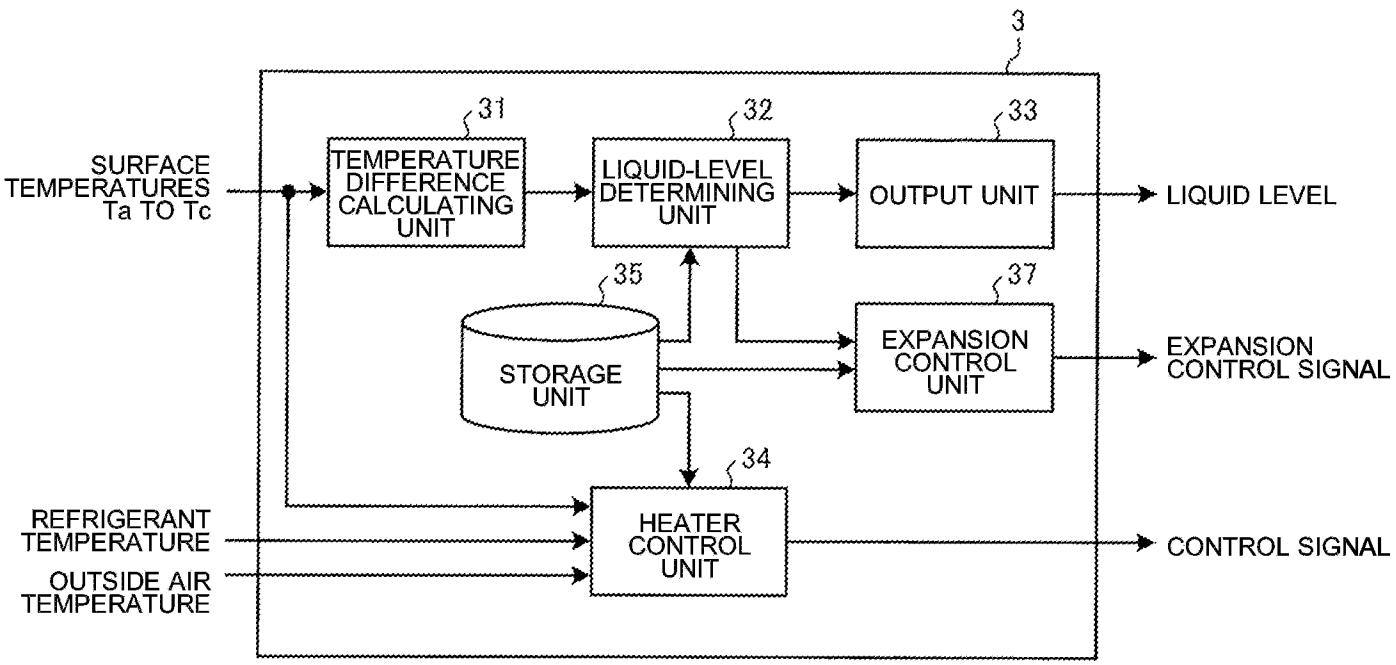
FIG. 10 is a block diagram showing a configuration of a controller of an air-conditioning apparatus according to Embodiment 2.

FIG. 10 is a block diagram showing a configuration of a controller 3 of an air-conditioning apparatus 1000 according to Embodiment 2. As shown in FIG. 10, the controller 3 includes a temperature difference calculating unit 31, a liquid-level determining unit 32, an output unit 33, a heater control unit 34, a storage unit 35, and an expansion control unit 37.

A difference from Embodiment 1 is that as shown in FIG. 10, the controller 3 includes the expansion control unit 37 instead of the frequency control unit 36 shown in FIG. 2. As other components and actions of the controller 3 are identical to those of Embodiment 1, a description of such components and actions is omitted here.

Further, also in Embodiment 2, the air-conditioning apparatus 1000 is described as an example of a refrigeration cycle apparatus. As the air-conditioning apparatus 1000 is identical in overall configuration to that shown in FIG. 1, a description of the air-conditioning apparatus 1000 is omitted here.

The expansion control unit 37 determines the opening degree of at least one of the expansion devices 20, 21A, and 21B with reference to opening degree information stored in the storage unit 35 on the basis of a result of the determination made by the liquid-level determining unit 32. The expansion control unit 37 sends at least one of the expansion devices 20, 21A, and 21B an opening degree control signal for controlling the opening degree of at least a corresponding one of the expansion devices 20, 21A, and 21B.

[Process of Controlling Opening Degrees of Expansion Devices 20, 21A, and 21B]

Figure 11:
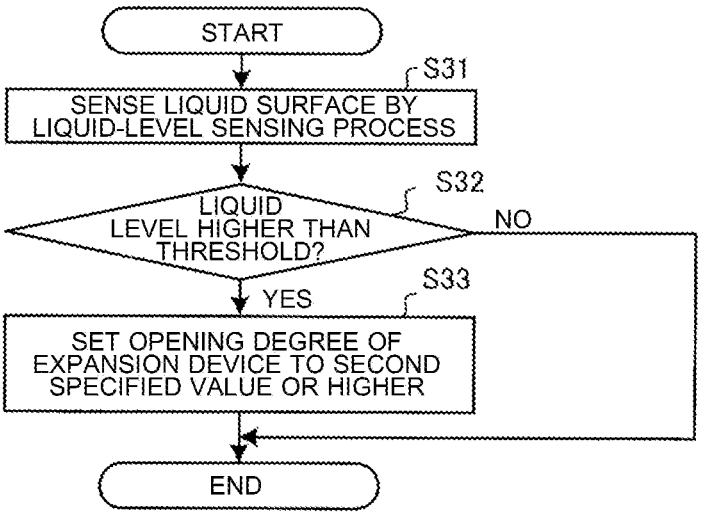
FIG. 11 is a flow chart showing a sequence of actions making up a process of controlling the opening degree of an expansion device of the air-conditioning apparatus according to Embodiment 2.

FIG. 11 is a flow chart showing a sequence of actions making up a process of controlling the opening degree of at least one of the expansion devices 20, 21A, and 21B of the air-conditioning apparatus 1000 according to Embodiment 2.

In step S31, the liquid level in the accumulator 14 is sensed by performing the process of the flow chart of FIG. 8 in a state in which the operation of the compressor 11 is stopped.

In step S32, the expansion control unit 37 of the controller 3 determines, on the basis of the liquid level sensed in step S31, whether the liquid level in the accumulator 14 is higher than the threshold Th. Specifically, in a case in which the liquid level in the accumulator 14 is the level a, the expansion control unit 37 determines that the liquid level in the accumulator 14 is higher than the threshold Th, and proceeds to step S33. On the other hand, in a case in which the liquid level in the accumulator 14 is the level b or the level c, the expansion control unit 37 determines that the liquid level is normal, and ends the process of FIG. 11.

In step S33, the expansion control unit 37 of the controller 3 sets the opening degree of at least one of the expansion devices 20, 21A, and 21B to the preset second specified value Sp2 or higher.

Thus, in Embodiment 2, the expansion control unit 37 controls the opening degree of at least one of the expansion devices 20, 21A, and 21B on the basis of the liquid level in the accumulator 14 as sensed by the liquid-level determining unit 32. Specifically, in a case in which the liquid level in the accumulator 14 is higher than the threshold Th, the expansion control unit 37 sets the opening degree of at least one of the expansion devices 20, 21A, and 21B to the second specified value Sp2 or higher. This makes it possible to reduce the occurrence of liquid return from the accumulator 14 to the compressor 11 upon start-up of the compressor 11. As a result, this makes it possible to bring about improvement in start-up characteristics of the air-conditioning apparatus 1000 during start-up of heating or during return to heating after completion of defrosting operation of the air-conditioning apparatus 1000.

On the other hand, in a case in which the liquid level in the accumulator 14 is determined to be normal, the expansion control unit 37 controls the opening degrees of the expansion devices 20, 21A, and 21B by the control method for normal operation. That is, the expansion control unit 37 controls the opening degrees of the expansion devices 20, 21A, and 21B such that a degree of subcooling SC at an outlet of the outdoor heat exchanger 13 or degrees of subcooling SC at outlets of the indoor heat exchangers 22A and 22B reach a target degree of subcooling.

In Embodiment 2, as noted above, during start-up of heating or during return to heating after completion of defrosting operation of the air-conditioning apparatus 1000, the liquid-level sensing device 15 senses the liquid level in the accumulator 14 installed in the outdoor unit 1. In a case in which the liquid level in the accumulator 14 is higher than the threshold Th, the controller 3 sets the opening degree of at least one of the expansion devices 20, 21A, and 21B to the second specified value Sp2 or higher for the limiting operation. This makes it possible to reduce the suction of low-pressure refrigerant into the compressor 11, thus making it possible to bring about improvement in start-up characteristics of the air-conditioning apparatus 1000 for heating. Further, as in Embodiment 1, also in Embodiment 2, the gas flow rate of refrigerant flowing through the refrigerant circuit is inhibited, thus the occurrence of liquid return is also reduced. This also makes it possible to bring about improvement in reliability of the compressor 11 without making the accumulator 14 complex in structure.

Modification of Embodiment 2

In a modification of Embodiment 2, the expansion control unit 37 sets the opening degree of at least one of the expansion devices 20, 21A, and 21B to the second specified value Sp2 or higher in step S33 of FIG. 11 and then determines an amount of decrease in the opening degree of at least a corresponding one of the expansion devices 20, 21A, and 21B to correspond to an amount of change in the liquid level in the accumulator 14.

Specifically, the liquid-level sensing process of FIG. 8 is performed twice or more. The expansion control unit 37 calculates a difference between the previous liquid level and the latest liquid level. The difference serves as the amount of change in the liquid level in the accumulator 14. The storage unit 35 has stored in its inside a table on which amounts of decrease in the opening degrees of the expansion devices 20, 21A, and 21B are predetermined for respective amounts of change in liquid level. The expansion control unit 37 refers to the table and determines an amount of decrease in the opening degree of at least one of the expansion devices 20, 21A, and 21B on the basis of the amount of change in the liquid level in the accumulator 14. This makes it possible to gradually decrease the opening degree of at least one of the expansion devices 20, 21A, and 21B to correspond to the amount of change in liquid level.

In Embodiment 2, the liquid-level sensing device 15 has three temperature sensors 17 such that there are three categories of liquid levels. However, in the modification of Embodiment 2, the liquid-level sensing device 15 may have four or more temperature sensors 17. In this case, it is possible to more finely sense amounts of change in liquid level.

In the modification of Embodiment 2, as noted above, the expansion control unit 37 determines an amount of decrease in the opening degree of at least one of the expansion devices 20, 21A, and 21B to correspond to an amount of change in the liquid level in the accumulator 14. This makes it possible to gradually decrease the opening degree of an expansion device while reducing the suction of low-pressure refrigerant into the compressor 11, thus making it possible to accelerate the condensation of refrigerant in the indoor heat exchangers 22A and 22B, which operate as condensers. As a result, this makes it possible to bring about further improvement in start-up characteristics of the air-conditioning apparatus 1000 than that of Embodiment 2.

Embodiment 3

Figure 12:
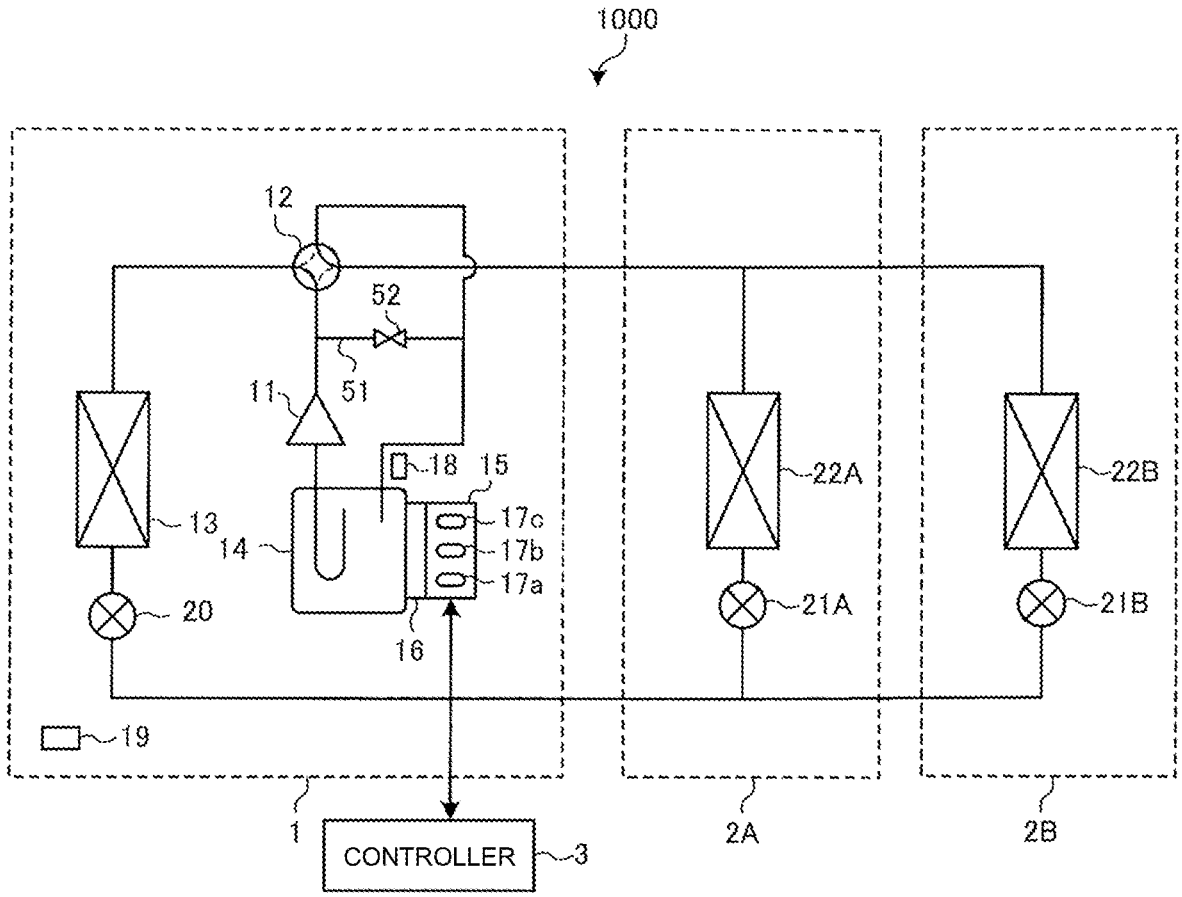
FIG. 12 is a schematic diagram showing a configuration of a refrigeration cycle apparatus according to Embodiment 3.

FIG. 12 is a schematic diagram showing a configuration of a refrigeration cycle apparatus according to Embodiment 3. FIG. 12 shows an air-conditioning apparatus 1000 as an example of the refrigeration cycle apparatus. A difference between FIG. 12 and FIG. 1 is that a bypass 51 and a hot-gas bypass valve 52 are provided in FIG. 12. As other components of the air-conditioning apparatus 1000 are identical to those shown in FIG. 1, a description of such components is omitted here.

The bypass 51 is provided between a high-pressure side that is a refrigerant discharge side of the compressor 11 and a low-pressure side that is an inflow side of the accumulator 14. The bypass 51 serves as a bypass through which high-temperature gas refrigerant discharged from the compressor 11 flows to the inflow side of the accumulator 14.

The hot-gas bypass valve 52 is provided to the bypass 51. The hot-gas bypass valve 52 is, for example, a solenoid valve. The hot-gas bypass valve 52 opens and closes to circulate or intercept the gas refrigerant flowing through the bypass 51. Specifically, in an open state, the hot-gas bypass valve 52 causes high-temperature gas refrigerant flowing from the discharge side of the compressor 11 into the bypass 51 to flow out to the inflow side of the accumulator 14. On the other hand, when in a closed state, the hot-gas bypass valve 52 intercepts the flow of gas refrigerant from the discharge side of the compressor 11 to the inflow side of the accumulator 14. The opening and closing of the hot-gas bypass valve 52 are controlled by the controller 3.

Figure 13:
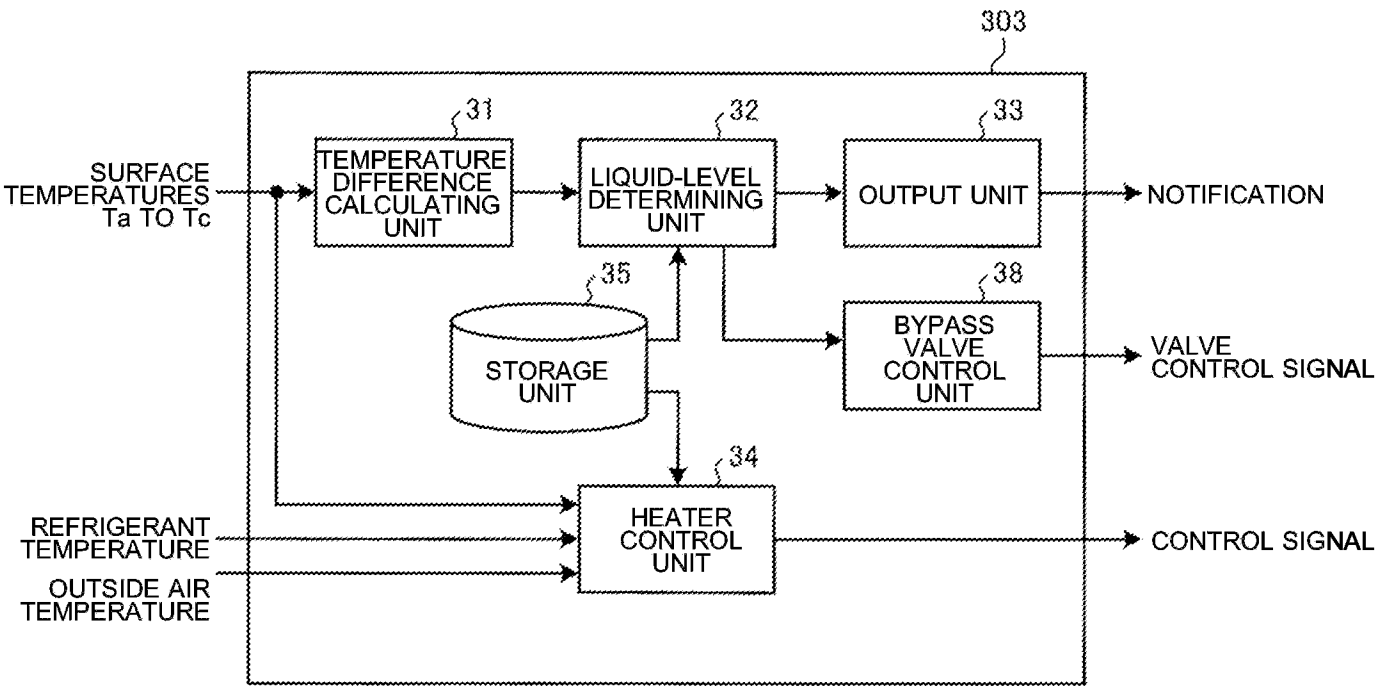
FIG. 13 is a block diagram showing a configuration of a controller of an air-conditioning apparatus according to Embodiment 3.

FIG. 13 is a block diagram showing a configuration of the controller 3 of the air-conditioning apparatus 1000 according to Embodiment 3. As shown in FIG. 13, the controller 3 includes a temperature difference calculating unit 31, a liquid-level determining unit 32, an output unit 33, a heater control unit 34, a storage unit 35, and a bypass valve control unit 38.

A difference from Embodiment 1 is that as shown in FIG. 13, the controller 3 includes the bypass valve control unit 38 instead of the frequency control unit 36 shown in FIG. 2. As other components and actions of the controller 3 are identical to those of Embodiment 1, a description of such components and actions is omitted here.

The bypass valve control unit 38 determines the opening and closing of the hot-gas bypass valve 52 on the basis of a result of the determination made by the liquid-level determining unit 32. The bypass valve control unit 38 sends the hot-gas bypass valve 52 an opening-and-closing control signal for controlling the opening and closing of the hot-gas bypass valve 52.

[Process of Controlling Opening and Closing of Hot-Gas Bypass Valve 52]

Figure 14:
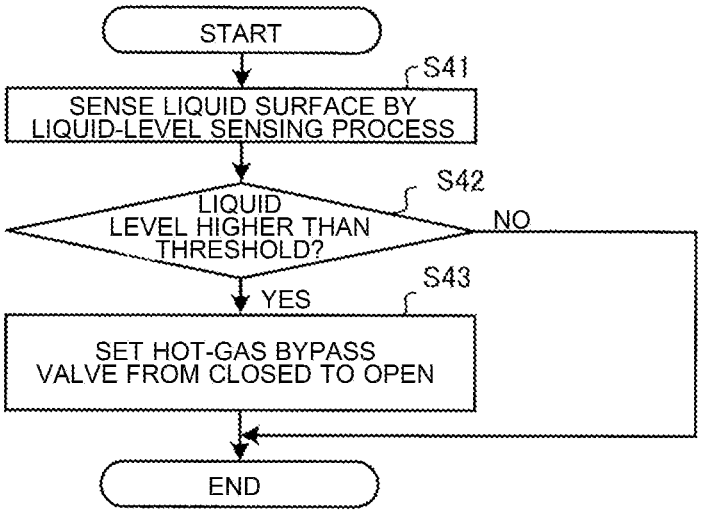
FIG. 14 is a flow chart showing a sequence of actions making up a process of controlling the opening and closing of a hot-gas bypass valve of the air-conditioning apparatus according to Embodiment 3.

FIG. 14 is a flow chart showing a sequence of actions making up a process of controlling the opening and closing of the hot-gas bypass valve 52 of the air-conditioning apparatus 1000 according to Embodiment 3.

In step S41, the liquid level in the accumulator 14 is sensed by performing the process of the flow chart of FIG. 8 in a state in which the operation of the compressor 11 is stopped.

In step S42, the bypass valve control unit 38 of the controller 3 determines, on the basis of the liquid level sensed in step S41, whether the liquid level in the accumulator 14 is higher than the threshold Th. Specifically, in a case in which the liquid level in the accumulator 14 is the level a, the bypass valve control unit 38 determines that the liquid level in the accumulator 14 is higher than the threshold Th, and proceeds to step S43. On the other hand, in a case in which the liquid level in the accumulator 14 is the level b or the level c, the bypass valve control unit 38 determines that the liquid level is normal, and ends the process of FIG. 14.

In step S43, the bypass valve control unit 38 of the controller 3 switches the hot-gas bypass valve 52 from a closed state to an open state.

Thus, in Embodiment 3, the bypass valve control unit 38 controls the opening and closing of the hot-gas bypass valve 52 on the basis of the liquid level in the accumulator 14 as sensed by the liquid-level determining unit 32. Specifically, in a case in which the liquid level in the accumulator 14 is higher than the threshold Th, the bypass valve control unit 38 switches the hot-gas bypass valve 52 from a closed state to an open state for the limiting operation. This causes high-temperature gas discharged from the compressor 11 to be introduced into a suction pipe of the accumulator 14 via the bypass 51 upon start-up of the compressor 11. This inflow of the high-temperature gas into the accumulator 14 causes liquid refrigerant in the accumulator 14 to evaporate. This results in delivery of the refrigerant from the accumulator 14 to the refrigerant circuit. This makes it possible to reduce the occurrence of liquid return from the accumulator 14 to the compressor 11. As a result, this makes it possible to bring about improvement in start-up characteristics of the air-conditioning apparatus 1000 during start-up of heating or during return to heating after completion of defrosting operation of the air-conditioning apparatus 1000.

On the other hand, in a case in which the liquid level in the accumulator 14 is determined to be normal, the bypass valve control unit 38 switches the hot-gas bypass valve 52 from an open state to a closed state. This causes the air-conditioning apparatus 1000 to perform a normal operation.

In Embodiment 3, as noted above, during start-up of heating or during return to heating after completion of defrosting operation of the air-conditioning apparatus 1000, the liquid-level sensing device 15 senses the liquid level in the accumulator 14 installed in the outdoor unit 1. In a case in which the liquid level in the accumulator 14 is higher than the threshold Th, the controller 3 switches the hot-gas bypass valve 52 from a closed state to an open state. This causes hot gas to be introduced from the compressor 11 into the inlet pipe 142 of the accumulator 14, causing the high-temperature hot gas to flow into the accumulator 14. This causes liquid refrigerant of the accumulator 14 to evaporate and be delivered to the refrigerant circuit excluding the accumulator 14. As a result, this makes it possible to reduce the suction of low-pressure refrigerant into the compressor 11, thus making it possible to reduce the occurrence of liquid return to the compressor 11. This makes it possible to bring about improvement in start-up characteristics of the air-conditioning apparatus 1000 for heating. Thus, in Embodiment 3, it is possible to bring about improvement in evaporation characteristics of the accumulator 14 with hot gas and bring about improvement in start-up characteristics during heating. It is also possible to bring about improvement in reliability of the compressor 11 without making the accumulator 14 complex in structure.

Embodiment 4

Figure 15:
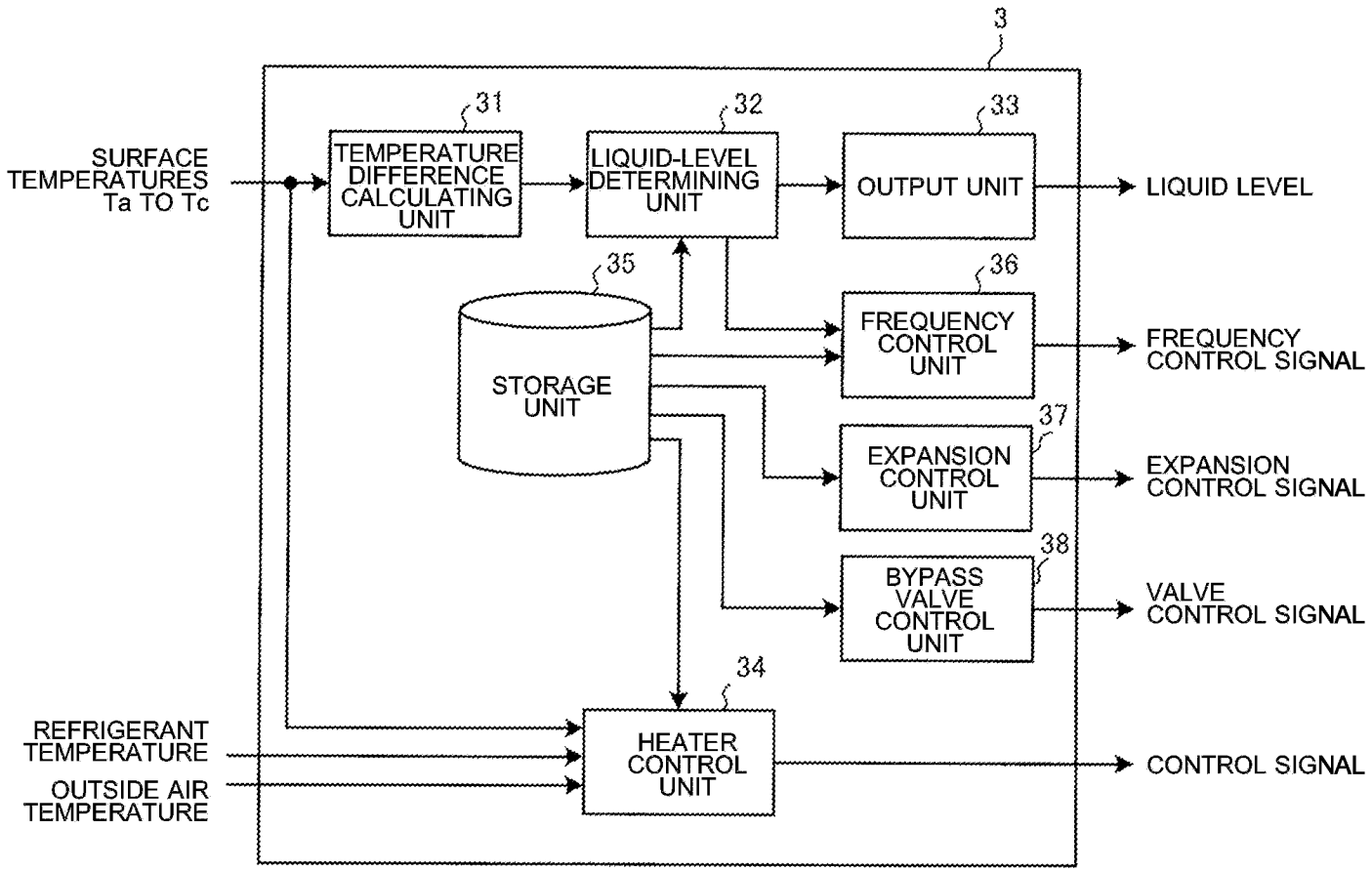
FIG. 15 is a block diagram showing a configuration of a controller of an air-conditioning apparatus according to Embodiment 4.

FIG. 15 is a block diagram showing a configuration of a controller 3 of an air-conditioning apparatus 1000 according to Embodiment 4. As shown in FIG. 15, the controller 3 includes a temperature difference calculating unit 31, a liquid-level determining unit 32, an output unit 33, a heater control unit 34, a storage unit 35, a frequency control unit 36, an expansion control unit 37, and a bypass valve control unit 38.

A difference from Embodiment 1 is that as shown in FIG. 15, the controller 3 further includes the expansion control unit 37 and the bypass valve control unit 38. As other components and actions of the controller 3 are identical to those of Embodiment 1, a description of such components and actions is omitted here. Further, the expansion control unit 37 is identical to that described in Embodiment 2. The bypass valve control unit 38 is identical to that described in Embodiment 3.

Further, also in Embodiment 4, the air-conditioning apparatus 1000 is described as an example of a refrigeration cycle apparatus. As the air-conditioning apparatus 1000 is identical in overall configuration to that shown in FIG. 12, a description of the air-conditioning apparatus 1000 is omitted here.

Thus, Embodiment 4 is a combination of Embodiments 1 to 3.

[Control Process]

Figure 16:
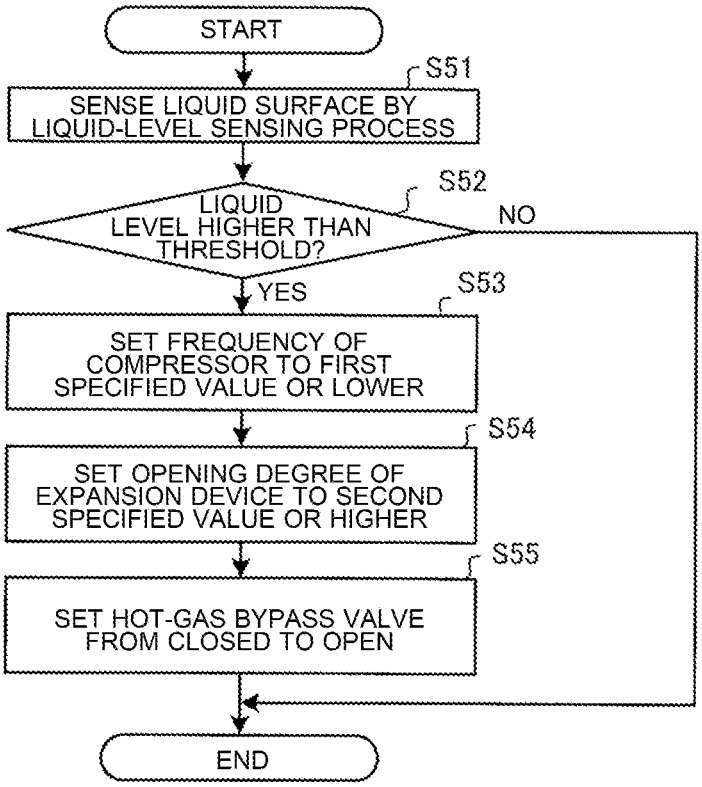
FIG. 16 is a flow chart showing a sequence of actions making up a control process of the air-conditioning apparatus according to Embodiment 4.

FIG. 16 is a flow chart showing a sequence of actions making up a control process of the air-conditioning apparatus 1000 according to Embodiment 4.

In step S51, the liquid level in the accumulator 14 is sensed by performing the process of the flow chart of FIG. 8 in a state in which the operation of the compressor 11 is stopped.

In step S52, the frequency control unit 36 of the controller 3 determines, on the basis of the liquid level sensed in step S51, whether the liquid level in the accumulator 14 is higher than the threshold Th. Specifically, in a case in which the liquid level in the accumulator 14 is the level a, the frequency control unit 36 determines that the liquid level in the accumulator 14 is higher than the threshold Th, and proceeds to step S53. On the other hand, in a case in which the liquid level in the accumulator 14 is the level b or the level c, the frequency control unit 36 determines that the liquid level is normal, and ends the process of FIG. 16.

In step S53, the frequency control unit 36 of the controller 3 sets the frequency of the compressor 11 to the preset first specified value Sp1 or lower.

Next, in step S54, the expansion control unit 37 of the controller 3 sets the opening degree of at least one of the expansion devices 20, 21A, and 21B to the preset second specified value Sp2 or higher.

Next, in step S55, the bypass valve control unit 38 of the controller 3 switches the hot-gas bypass valve 52 from a closed state to an open state.

Thus, in Embodiment 4, the frequency control unit 36 sets the frequency of the compressor 11 to the first specified value Sp1 or lower for a first limiting operation on the basis of the liquid level in the accumulator 14 as sensed by the liquid-level determining unit 32. Furthermore, the expansion control unit 37 sets the opening degree of at least one of the expansion devices 20, 21A, and 21B to the second specified value Sp2 or higher for a second limiting operation. Furthermore, the bypass valve control unit 38 switches the hot-gas bypass valve 52 from a closed state to an open state for a third limiting operation. This makes it possible to reduce the suction of low-pressure refrigerant into the compressor 11 upon start-up of the compressor 11, thus making it possible to reduce the occurrence of liquid return from the accumulator 14 to the compressor 11. As a result, this makes it possible to bring about improvement in start-up characteristics of the air-conditioning apparatus 1000 during start-up of heating or during return to heating after completion of defrosting operation of the air-conditioning apparatus 1000.

On the other hand, in a case in which the liquid level in the accumulator 14 is determined to be normal, the frequency control unit 36 ends the process of FIG. 16 to perform a normal operation.

As noted above, as Embodiment 4 is a combination of Embodiments 1 to 3, in Embodiment, it is possible to bring about effects that are similar to those of Embodiments 1 to 3.

Although, in Embodiment 4, the frequency control unit 36 performs the liquid-level determining process of step S52, this is not intended to impose any limitation. For example, the expansion control unit 37 or the bypass valve control unit 38 may perform the liquid-level determining process of step S52.

Further, although, in Embodiments 1 to 4, the frequency control unit 36, the expansion control unit 37, or the bypass valve control unit 38 performs the liquid-level determining process, this is not intended to impose any limitation. For example, the liquid-level determining unit 32 may perform the liquid-level determining process.

Embodiment 5

Figure 17:
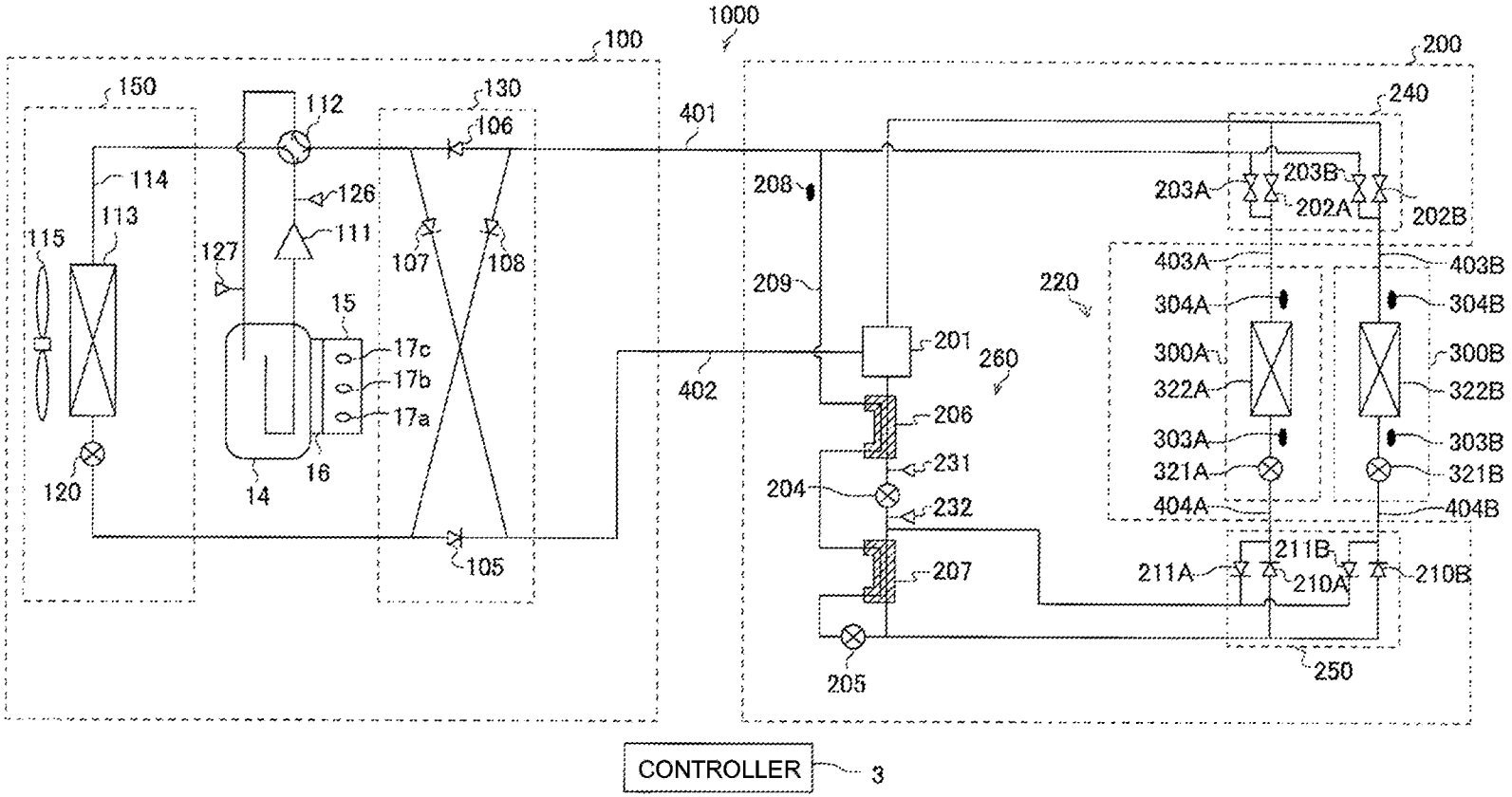
FIG. 17 is a schematic diagram showing a configuration of a refrigeration cycle apparatus according to Embodiment 5.

FIG. 17 is a schematic diagram showing a configuration of a refrigeration cycle apparatus according to Embodiment 5. FIG. 17 shows an air-conditioning apparatus 1000 as an example of the refrigeration cycle apparatus.

As shown in FIG. 17, the air-conditioning apparatus 1000 includes an outdoor unit 100, a plurality of indoor units 300A and 300B, a relay unit 200, and a controller 3. As in the case of FIG. 1, the controller 3 is provided outside the outdoor unit 100, the relay unit 200, and the indoor units 300A and 300B. However, this is not intended to impose any limitation, and the controller 3 may be provided inside any of the outdoor unit 100, the relay unit 200, and the indoor units 300A and 300B. Although in Embodiment 5, a case is illustrated in which two indoor units 300A and 300B are connected to one outdoor unit 100, two or more outdoor units 100 may be provided. Further, three or more indoor units 300A and 300B may be connected.

As shown in FIG. 17, the outdoor unit 100, the indoor units 300A and 300B, and the relay unit 200 are connected by refrigerant pipes to form a refrigerant circuit. The outdoor unit 100 is configured to supply the two indoor units 300A and 300B with heating energy or cooling energy. The two indoor units 300A and 300B are connected in parallel to each other, and are identical in configuration to each other. The indoor units 300A and 300B are configured to cool or heat an air-conditioned space such as the inside of a room with heating energy or cooling energy supplied from the outdoor unit 100. The relay unit 200 is interposed between the outdoor unit 100 and the indoor units 300A and 300B, and is configured to switch, upon request of the indoor units 300A and 300B, the flows of refrigerant supplied from the outdoor unit 100.

Further, the air-conditioning apparatus 1000 includes a load capacity detecting unit 220 configured to detect cooling and heating load capacities of the plurality of indoor units 300A and 300B. The cooling and heating load capacities here are cooling load capacities and heating load capacities of the plurality of indoor units 300A and 300B. The load capacity detecting unit 220 includes liquid pipe temperature detecting units 303A and 303B and gas pipe temperature detecting units 304A and 304B.

Note here that the outdoor unit 100 and the relay unit 200 are connected on a high-pressure side by a high-pressure pipe 402 through which high-pressure refrigerant flows and are connected on a low-pressure side by a low-pressure pipe 401 through which low-pressure refrigerant flows. Further, the relay unit 200 and the indoor unit 300A are connected by a gas branch pipe 403A, and the relay unit 200 and the indoor unit 300B are connected by a gas branch pipe 403B. Gaseous refrigerant flows mostly through the gas branch pipes 403A and 403B. Further, the relay unit 200 and the indoor unit 300A are connected by a liquid branch pipe 404A, and the relay unit 200 and the indoor unit 300B are connected by a liquid branch pipe 404B. Liquid refrigerant flows mostly through the liquid branch pipes 404A and 404B.

(Outdoor Unit 100)

The outdoor unit 100 includes a capacity-variable compressor 111, a refrigerant flow switching device 112, a heat exchange unit 150, an accumulator 14, and a flow control unit 130. The flow control unit 130 limits the directions in which refrigerant flows. The refrigerant flow switching device 112 switches the directions in which refrigerant flows through the outdoor unit 100. Although the refrigerant flow switching device 112 is a four-way valve in the illustrated case, the refrigerant flow switching device 112 may be a combination of two-way valves, three-way valves, or other devices.

The heat exchange unit 150 includes a main pipe 114, an air-sending device 115, an outdoor heat exchanger 113 serving as a first heat exchanger, and an expansion device 120 serving as a first expansion device.

The outdoor heat exchanger 113 operates as an evaporator or a condenser. In a case in which the outdoor heat exchanger 113 is an air-cooled heat exchanger, the outdoor heat exchanger 113 is formed to exchange heat between refrigerant and outdoor air, and in a case in which the outdoor heat exchanger 113 is an water-cooled heat exchanger, the outdoor heat exchanger 113 is formed to exchange heat between refrigerant and water, brine, or other substances. The air-sending device 115 is configured to control a heat exchange capacity by varying the amount of air that is sent to the outdoor heat exchanger 113. The main pipe 114 has a first end connected to the refrigerant flow switching device 112 and a second end connected to the high-pressure pipe 402, and is provided with the outdoor heat exchanger 113 and the expansion device 120.

The expansion device 120 is connected in series to the outdoor heat exchanger 113 through the main pipe 114, and is configured to adjust the flow rate of refrigerant flowing through the main pipe 114. The expansion device 120 is, for example, an opening-degree-variable electronic expansion valve or other devices. The opening degree of the expansion device 120 is controlled by the controller 3.

The flow control unit 130 includes a third check valve 105, a fourth check valve 106, a fifth check valve 107, and a sixth check valve 108. The third check valve 105 is provided to a pipe connecting the heat exchange unit 150 with the high-pressure pipe 402, and allows passage of refrigerant from the heat exchange unit 150 toward the high-pressure pipe 402. The fourth check valve 106 is provided to a pipe connecting the refrigerant flow switching device 112 of the outdoor unit 100 with the low-pressure pipe 401, and allows passage of refrigerant from the low-pressure pipe 401 toward the refrigerant flow switching device 112. The fifth check valve 107 is provided to a pipe connecting the refrigerant flow switching device 112 of the outdoor unit 100 with the high-pressure pipe 402, and allows passage of refrigerant from the refrigerant flow switching device 112 toward the high-pressure pipe 402. The sixth check valve 108 is provided to a pipe connecting the heat exchange unit 150 with the low-pressure pipe 401, and allows passage of refrigerant from the low-pressure pipe 401 toward the heat exchange unit 150.

Further, the outdoor unit 100 is provided with a discharge pressure detecting unit 126. The discharge pressure detecting unit 126 is provided to a pipe connecting the refrigerant flow switching device 112 with a discharge side of the compressor 111, and is configured to detect a discharge pressure of the compressor 111. The discharge pressure detecting unit 126 is, for example, a sensor or other devices, and sends a signal representing a detected discharge pressure to the controller 3. The discharge pressure detecting unit 126 may include a storage device or other devices. In this case, the discharge pressure detecting unit 126 accumulates data representing detected discharge pressures in the storage device or other devices for a preset period of time and sends a signal containing data representing detected discharge pressures to the controller 3 in each set cycle.

Moreover, the outdoor unit 100 is provided with a suction pressure detecting unit 127. The suction pressure detecting unit 127 is provided to a pipe connecting the refrigerant flow switching device 112 with the accumulator 14, and is configured to detect a suction pressure of the compressor 111. The suction pressure detecting unit 127 is, for example, a sensor or other devices, and sends a signal representing a detected suction pressure to the controller 3. The suction pressure detecting unit 127 may include a storage device or other devices. In this case, the suction pressure detecting unit 127 accumulates data representing detected suction pressures in the storage device or other devices for a preset period of time and sends a signal containing data representing detected suction pressures to the controller 3 in each set cycle.

(Indoor Units 300A and 300B)

The indoor units 300A and 300B include indoor heat exchangers 322A and 322B serving as second heat exchangers and expansion devices 321A and 321B serving as second expansion devices, respectively. The indoor heat exchangers 322A and 322B operate as condensers or evaporators. The expansion devices 321A and 321B adjust the flow rates of refrigerant circulating through the indoor units 300A and 300B. Each of the indoor units 300A and 300B is configured to cool or heat an air-conditioned space such as the inside of a room with heating energy or cooling energy supplied from the outdoor unit 100. The expansion devices 321A and 321B are, for example, opening-degree-variable electronic expansion valves or other devices.

The indoor units 300A and 300B are provided with the gas pipe temperature detecting units 304A and 304B and the liquid pipe temperature detecting units 303A and 303B, respectively. The gas pipe temperature detecting unit 304A is provided between the indoor heat exchanger 322A and the relay unit 200, and is configured to detect the temperature of refrigerant flowing through the gas branch pipe 403A connecting the indoor heat exchanger 322A with the relay unit 200. The gas pipe temperature detecting unit 304B is provided between the indoor heat exchanger 322B and the relay unit 200, and is configured to detect the temperature of refrigerant flowing through the gas branch pipe 403B connecting the indoor heat exchanger 322B with the relay unit 200. The gas pipe temperature detecting units 304A and 304B are, for example, thermistors or other devices, and send signals representing detected temperatures to the controller 3. The gas pipe temperature detecting units 304A and 304B may include storage devices or other devices. In this case, the gas pipe temperature detecting units 304A and 304B accumulate data representing detected temperatures in the storage devices or other devices for a preset period of time and send signals containing data representing detected temperatures to the controller 3 in each set cycle.

The liquid pipe temperature detecting unit 303A is provided between the indoor heat exchanger 322A and the expansion device 321A, and the liquid pipe temperature detecting unit 303B is provided between the indoor heat exchanger 322B and the expansion device 321B. The liquid pipe temperature detecting unit 303A detects the temperature of refrigerant flowing through the liquid branch pipe 404A connecting the indoor heat exchanger 322A with the expansion device 321A, and the liquid pipe temperature detecting unit 303B detects the temperature of refrigerant flowing through the liquid branch pipe 404B connecting the indoor heat exchanger 322B with the expansion device 321B. The liquid pipe temperature detecting units 303A and 303B are, for example, thermistors or other devices, and send signals representing detected temperatures to the controller 3. The liquid pipe temperature detecting units 303A and 303B may include storage devices or other devices. In this case, the liquid pipe temperature detecting units 303A and 303B accumulate data representing detected temperatures in the storage devices or other devices for a preset period of time and send signals containing data representing detected temperatures to the controller 3 in each set cycle.

(Relay Unit 200)

The relay unit 200 includes a first branching unit 240, a second branching unit 250, a gas-liquid separator 201, a relay bypass pipe 209, a liquid outflow control valve 204, a heat exchange unit 260, and a relay bypass flow control valve 205. The relay unit 200 is provided between the outdoor unit 100 and the indoor units 300A and 300B. The relay unit 200 switches, upon request of the indoor units 300A and 300B, the flows of refrigerant supplied from the outdoor unit 100, and distributes, to the plurality of indoor units 300A and 300B, the refrigerant supplied from the outdoor unit 100.

The first branching unit 240 has first ends connected to the gas branch pipes 403A and 403B and second ends connected to the low-pressure pipe 401 and the high-pressure pipe 402, and is formed to allow refrigerant to circulate in one direction during cooling operation and allow refrigerant to circulate in another direction during heating operation. The first branching unit 240 includes heating solenoid valves 202A and 202B and cooling solenoid valves 203A and 203B. The heating solenoid valves 202A and 202B have their respective first ends connected to the gas branch pipes 403A and 403B, have their respective second ends connected to the high-pressure pipe 402, and are configured to be opened during heating operation and closed during cooling operation. The cooling solenoid valves 203A and 203B have their respective first ends connected to the gas branch pipes 403A and 403B, have their respective second ends connected to the low-pressure pipe 401, and are configured to be opened during cooling operation and closed during heating operation.

The second branching unit 250 has first ends connected to the liquid branch pipes 404A and 404B and second ends connected to the low-pressure pipe 401 and the high-pressure pipe 402, and is formed to allow refrigerant to circulate in one direction during cooling operation and allow refrigerant to circulate in another direction during heating operation. The second branching unit 250 includes first check valves 210A and 210B and second check valves 211A and 211B.

The first check valves 210A and 210B have their respective first ends connected to the liquid branch pipes 404A and 404B, have their respective second ends connected to the high-pressure pipe 402, and allow passage of refrigerant from the high-pressure pipe 402 toward the liquid branch pipes 404A and 404B.

The first check valves 211A and 211B have their respective first ends connected to the liquid branch pipes 404A and 404B, have their respective second ends connected to the low-pressure pipe 401, and allow passage of refrigerant from the liquid branch pipes 404A and 404B toward the low-pressure pipe 401.

The gas-liquid separator 201 is configured to separate refrigerant into gaseous refrigerant and liquid refrigerant, and has an inflow side connected to the high-pressure pipe 402, a gas outflow side connected to the first branching unit 240, and a liquid outflow side connected to the second branching unit 250. The relay bypass pipe 209 is formed to connect the second branching unit 250 with the low-pressure pipe 401. The liquid outflow control valve 204 is connected to the liquid outflow side of the gas-liquid separator 201, and is, for example, an opening-degree-variable electronic expansion valve or other devices. The liquid outflow control valve 204 is configured to adjust the flow rate of liquid refrigerant flowing out from the gas-liquid separator 201.

The heat exchange unit 260 is composed of a first heat exchange unit 206 and a second heat exchange unit 207. The first heat exchange unit 206 is provided between the liquid outflow side of the gas-liquid separator 201 and the liquid outflow control valve 204 and to the relay bypass pipe 209. The first heat exchange unit 206 is formed to exchange heat between the liquid refrigerant flowing out from the gas-liquid separator 201 and refrigerant flowing through the relay bypass pipe 209. The second heat exchange unit 207 is provided downstream of the liquid outflow control valve 204 and to the relay bypass pipe 209. The second heat exchange unit 207 is formed to exchange heat between refrigerant flowing out from the liquid outflow control valve 204 and the refrigerant flowing through the relay bypass pipe 209.

The relay bypass flow control valve 205 is connected to an upstream side of the second heat exchange unit 207 in the relay bypass pipe 209, and is, for example, an opening-degree-variable electronic expansion valve or other devices. The relay bypass flow control valve 205 is configured to adjust the flow rate of a portion of refrigerant flowing out from the second heat exchange unit 207 that has flowed into the relay bypass pipe 209.

Note here that the first check valves 210A and 2106 have their upstream sides connected to a downstream side of the second heat exchange unit 207 and the relay bypass pipe 209. Thus, refrigerant having flowed out from the second heat exchange unit 207 divides into refrigerant flowing toward the first check valves 210A and 2106 and refrigerant flowing into the relay bypass pipe 209. Further, the second check valves 211A and 211B have their downstream sides connected between the liquid outflow control valve 204 and the upstream side of the second heat exchange unit 207. That is, refrigerant having flowed out from the second check valves 211A and 211B flows into the second heat exchange unit 207, exchanges heat, and then divides into refrigerant flowing toward the first check valves 210A and 210B and refrigerant flowing into the relay bypass pipe 209.

Further, the relay unit 200 is provided with a liquid outflow pressure detecting unit 231, a downstream liquid outflow pressure detecting unit 232, and a relay bypass temperature detecting unit 208. The liquid outflow pressure detecting unit 231 is provided between the first heat exchange unit 206 and an upstream side of the liquid outflow control valve 204, and is configured to detect a pressure of refrigerant at the liquid outflow side of the gas-liquid separator 201. The liquid outflow pressure detecting unit 231 is, for example, a sensor or other devices, and sends a signal representing a detected pressure to the controller 3. The liquid outflow pressure detecting unit 231 may include a storage device or other devices. In this case, the liquid outflow pressure detecting unit 231 accumulates data representing detected pressures in the storage device or other devices for a preset period of time and sends a signal containing data representing detected pressures to the controller 3 in each set cycle.

The downstream liquid outflow pressure detecting unit 232 is provided between a downstream side of the liquid outflow control valve 204 and the second heat exchange unit 207, and is configured to detect a pressure of refrigerant having flowed out from the liquid outflow control valve 204. The downstream liquid outflow pressure detecting unit 232 is, for example, a sensor or other devices, and sends a signal representing a detected pressure to the controller 3. The downstream liquid outflow pressure detecting unit 232 may include a storage device or other devices. In this case, the downstream liquid outflow pressure detecting unit 232 accumulates data representing detected pressures in the storage device or other devices for a preset period of time and sends a signal containing data representing detected pressures to the controller 3 in each set cycle. Note here that the liquid outflow control valve 204 has its opening degree adjusted by the controller 3 such that a difference between a pressure detected by the liquid outflow pressure detecting unit 231 and a pressure detected by the downstream liquid outflow pressure detecting unit 232 is constant.

The relay bypass temperature detecting unit 208 is provided to the relay bypass pipe 209, and is configured to detect a pressure of refrigerant flowing through the relay bypass pipe 209. The relay bypass temperature detecting unit 208 is, for example, a thermistor or other devices, and sends a signal representing a detected temperature to the controller 3. The relay bypass temperature detecting unit 208 may include a storage device or other devices. In this case, the relay bypass temperature detecting unit 208 accumulates data representing detected temperatures in the storage device or other devices for a preset period of time and sends a signal containing data representing detected temperatures to the controller 3 in each set cycle. Note here that the controller 3 adjusts the opening degree of the relay bypass flow control valve 205 on the basis of at least one of a pressure detected by the liquid outflow pressure detecting unit 231, a pressure detected by the downstream liquid outflow pressure detecting unit 232, and a temperature detected by the relay bypass temperature detecting unit 208.

As shown in FIG. 17, also in Embodiment 5, a liquid-level sensing device 15 is attached to the accumulator 14, as in the case of Embodiments 1 to 4. As the accumulator 14 and the liquid-level sensing device 15 are identical in configuration and operation to those of Embodiment 1, a description of the configurations and operations of the accumulator 14 and the liquid-level sensing device 15 is omitted here.

Also in Embodiment 5, as in the case of Embodiment 1, during start-up of heating or during return to heating after completion of defrosting operation of the air-conditioning apparatus 1000, the liquid-level sensing device 15 senses the liquid level in the accumulator 14 installed in the outdoor unit 100. In a case in which the liquid level in the accumulator 14 is higher than the preset threshold Th, the controller 3 makes the frequency of the compressor 111 installed in the outdoor unit 100 lower than or equal to the preset first specified value Sp1 for the limiting operation. This makes it possible to reduce the occurrence of liquid return from the accumulator 14 to the compressor 111, making it possible to bring about improvement in start-up characteristics of the air-conditioning apparatus 1000. The following describes how the controller 3 operates.

[Process of Controlling Frequency of Compressor 111]

The controller 3 operates in the same manner as in the flow chart of FIG. 9 described above. Therefore, how the controller 3 operates is described with reference to FIG. 9. It should be noted that the controller 3 is configured in the same manner as shown in FIG. 2.

In step S21, the liquid level in the accumulator 14 is sensed by performing the process of the flow chart of FIG. 8 in a state in which the operation of the compressor 111 is stopped.

In step S22, the frequency control unit 36 of the controller 3 determines, on the basis of the liquid level sensed in step S21, whether the liquid level in the accumulator 14 is higher than the threshold Th. Specifically, in a case in which the liquid level in the accumulator 14 is the level a, the frequency control unit 36 determines that the liquid level in the accumulator 14 is higher than the threshold Th, and proceeds to step S23. On the other hand, in a case in which the liquid level in the accumulator 14 is the level b or the level c, the frequency control unit 36 determines that the liquid level is normal, and ends the process of FIG. 9.

In step S23, the frequency control unit 36 of the controller 3 sets the frequency of the compressor 111 to the preset first specified value Sp1 or lower.

Thus, in Embodiment 5, the frequency control unit 36 controls the frequency of the compressor 111 on the basis of the liquid level in the accumulator 14 as sensed by the liquid-level determining unit 32. Specifically, in a case in which the liquid level in the accumulator 14 is higher than the threshold Th, the frequency control unit 36 sets the frequency of the compressor 111 to the first specified value Sp1 or lower. This makes it possible to reduce the occurrence of liquid return from the accumulator 14 to the compressor 111 upon start-up of the compressor 111. As a result, this makes it possible to bring about improvement in start-up characteristics of the air-conditioning apparatus 1000 during start-up of heating or during return to heating after completion of defrosting operation of the air-conditioning apparatus 1000.

On the other hand, in a case in which the liquid level in the accumulator 14 is determined to be normal, the frequency control unit 36 controls the frequency of the compressor 111 by a control method for normal operation. That is, the frequency control unit 36 controls the frequency of the compressor 111 such that a target condensing temperature or a target discharge temperature is achieved.

In Embodiment 5, as noted above, during start-up of heating or during return to heating after completion of defrosting operation of the air-conditioning apparatus 1000, the liquid-level sensing device 15 senses the liquid level in the accumulator 14 installed in the outdoor unit 100. In a case in which the liquid level in the accumulator 14 is higher than the threshold Th, the controller 3 makes the frequency of the compressor 111 installed in the outdoor unit 100 lower than or equal to the preset first specified value Sp1. This inhibits the rise in gas flow rate of refrigerant flowing through the refrigerant circuit, making it possible to reduce the suction of low-pressure refrigerant into the compressor 111. This makes it possible to reduce the occurrence of liquid return to the compressor 111, making it possible to bring about improvement in start-up characteristics of the air-conditioning apparatus 1000 for heating. This also makes it possible to bring about improvement in reliability of the compressor 111 without making the accumulator 14 complex in structure.

Also in Embodiment 5, as in the case of the modification of Embodiment 1, an amount of increase in the frequency of the compressor 111 may be determined to correspond to an amount of change in the liquid level in the accumulator 14 after the frequency of the compressor 111 has been set to the first specified value Sp1 or lower. In this case, effects that are similar to those of the modification of Embodiment 1 are brought about.

Modification 1 of Embodiment 5

The controller 3 may be configured as shown in FIG. 10, as in the case of Embodiment 2. In this case, the controller 3 performs the following process in accordance with the flow chart of FIG. 11 described above.

In step S31, the liquid level in the accumulator 14 is sensed by performing the process of the flow chart of FIG. 8 in a state in which the operation of the compressor 111 is stopped.

In step S32, the expansion control unit 37 of the controller 3 determines, on the basis of the liquid level sensed in step S31, whether the liquid level in the accumulator 14 is higher than the threshold Th. Specifically, in a case in which the liquid level in the accumulator 14 is the level a, the expansion control unit 37 determines that the liquid level in the accumulator 14 is higher than the threshold Th, and proceeds to step S33. On the other hand, in a case in which the liquid level in the accumulator 14 is the level b or the level c, the expansion control unit 37 determines that the liquid level is normal, and ends the process of FIG. 11.

In step S33, the expansion control unit 37 of the controller 3 sets the opening degree of at least one of the expansion devices 120, 321A, and 321B to the preset second specified value Sp2 or higher.

Thus, in Modification 1 of Embodiment 5, the expansion control unit 37 controls the opening degree of at least one of the expansion devices 120, 321A, and 321B on the basis of the liquid level in the accumulator 14 as sensed by the liquid-level determining unit 32. Specifically, in a case in which the liquid level in the accumulator 14 is higher than the threshold Th, the expansion control unit 37 sets the opening degree of at least one of the expansion devices 120, 321A, and 321B to the second specified value Sp2 or higher for the limiting operation. This makes it possible to reduce the occurrence of liquid return from the accumulator 14 to the compressor 111 upon start-up of the compressor 111. As a result, this makes it possible to bring about improvement in start-up characteristics of the air-conditioning apparatus 1000 during start-up of heating or during return to heating after completion of defrosting operation of the air-conditioning apparatus 1000.

On the other hand, in a case in which the liquid level in the accumulator 14 is determined to be normal, the expansion control unit 37 controls the opening degree of the expansion device 120, 321A, or 321B by the control method for normal operation.

That is, the expansion control unit 37 controls the opening degree of the expansion device 120, 321A, or 321B such that a degree of subcooling SC at an outlet of the outdoor heat exchanger 113 or the indoor heat exchanger 322A or 322B reaches a target degree of subcooling.

In Modification 1 of Embodiment 5, as noted above, during start-up of heating or during return to heating after completion of defrosting operation of the air-conditioning apparatus 1000, the liquid-level sensing device 15 senses the liquid level in the accumulator 14 installed in the outdoor unit 100. In a case in which the liquid level in the accumulator 14 is higher than the threshold Th, the controller 3 sets the opening degree of at least one of the expansion devices 120, 321A, and 321B to the second specified value Sp2 or higher. This makes it possible to reduce the suction of low-pressure refrigerant into the compressor 111, thus making it possible to reduce the occurrence of liquid return to the compressor 111 and making it possible to bring about improvement in start-up characteristics of the air-conditioning apparatus 1000 for heating. This also makes it possible to bring about improvement in reliability of the compressor 111 without making the accumulator 14 complex in structure.

Also in Modification 1 of Embodiment 5, as in the case of the modification of Embodiment 2, an amount of decrease in the opening degree of at least one of the expansion devices 120, 321A, and 321B may be determined to correspond to an amount of change in the liquid level in the accumulator 14 after the opening degree of at least a corresponding one of the expansion devices 120, 321A, and 321B has been set to the second specified value Sp2 or higher. In this case, effects that are similar to those of the modification of Embodiment 2 are brought about.

Modification 2 of Embodiment 5

Also in Embodiment 5, as in the case of Embodiment 3, as shown in FIG. 12, the bypass 51 may be provided between a high-pressure side that is a refrigerant discharge side of the compressor 111 and a low-pressure side that is an inflow side of the accumulator 14. Further, as shown in FIG. 12, the bypass 51 may be provided with the hot-gas bypass valve 52. As the bypass 51 and the hot-gas bypass valve 52 are identical in configuration and operation to those of Embodiment 3, a description of the configurations and operations of the bypass 51 and the hot-gas bypass valve 52 is omitted here.

In this case, the controller 3 is configured as shown in FIG. 13 described above. Further, the controller 3 controls the opening and closing of the hot-gas bypass valve 52 in accordance with the flow chart of FIG. 14 described above.

In Modification 2 of Embodiment 5, as noted above, during start-up of heating or during return to heating after completion of defrosting operation of the air-conditioning apparatus 1000, the liquid-level sensing device 15 senses the liquid level in the accumulator 14 installed in the outdoor unit 100. In a case in which the liquid level in the accumulator 14 is higher than the threshold Th, the controller 3 switches the hot-gas bypass valve 52 from a closed state to an open state for the limiting operation. This causes high-temperature hot gas to flow into the accumulator 14, thus causing liquid refrigerant in the accumulator 14 to evaporate and be delivered to the refrigerant circuit. As a result, this makes it possible to reduce the suction of low-pressure refrigerant into the compressor 111, thus making it possible to reduce the occurrence of liquid return to the compressor 111 and making it possible to bring about improvement in start-up characteristics of the air-conditioning apparatus 1000 for heating.

Modification 3 of Embodiment 5

Also in Embodiment 5, as in the case of Embodiment 4, the controller 3 may be configured as shown in FIG. 15 described above.

In this case, the controller 3 performs a process in accordance with the flow chart of FIG. 16 described above. As this process is equivalent to a combination of Embodiment 5, Modification 1 of Embodiment 5, and Modification 2 of Embodiment 5, a description of the process is omitted here.

As noted above, as Modification 3 of Embodiment 5 is a combination of Embodiment 5, Modification 1 of Embodiment 5, and Modification 2 of Embodiment 5, Modification 3 of Embodiment 5 brings about effects that are similar to those of Embodiment 5, Modification 1 of Embodiment 5, and Modification 2 of Embodiment 5.

Embodiment 6

Figure 18:
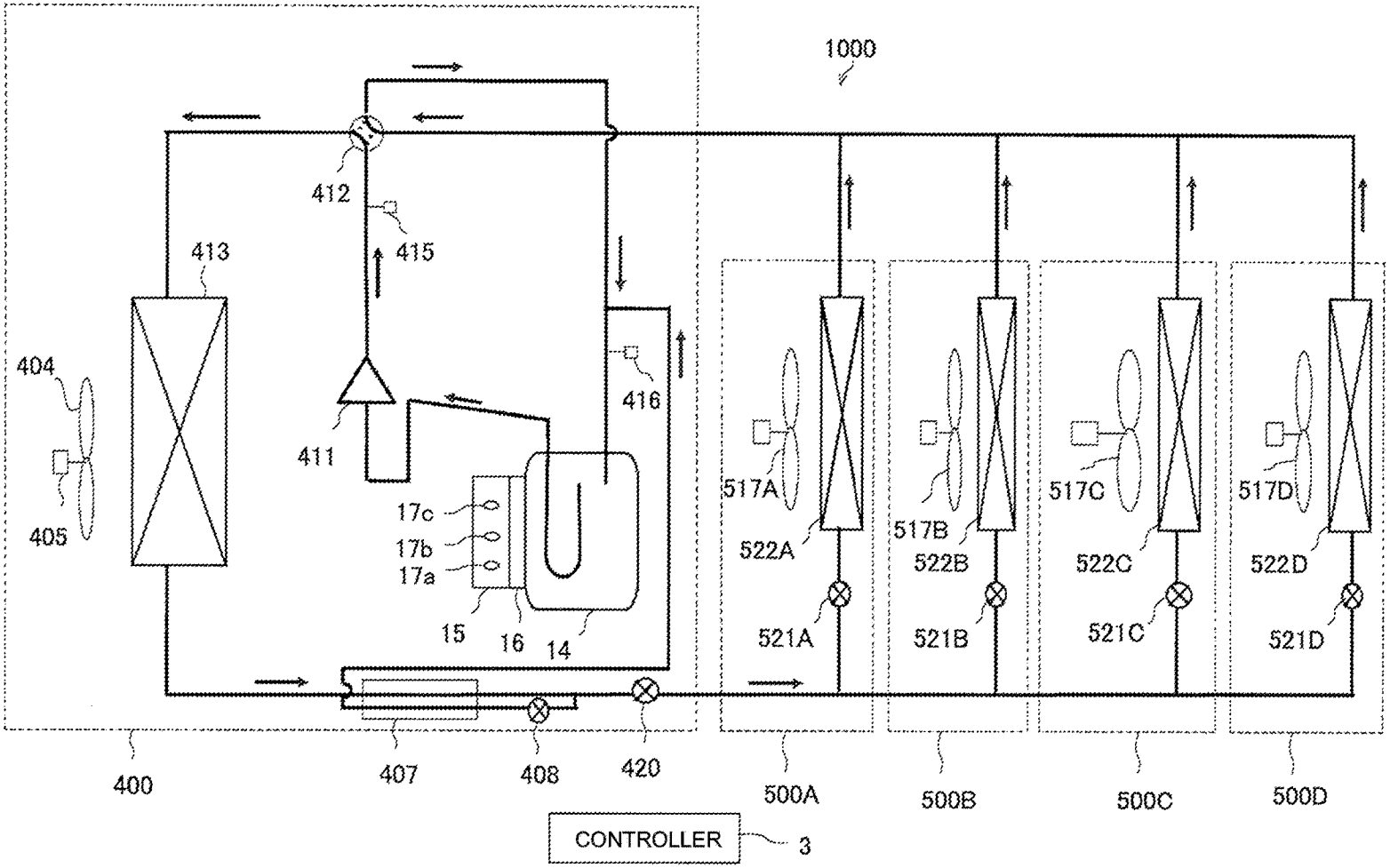
FIG. 18 is a schematic diagram showing a configuration of a refrigeration cycle apparatus according to Embodiment 6.

FIG. 18 is a schematic diagram showing a configuration of a refrigeration cycle apparatus according to Embodiment 6. FIG. 18 shows an air-conditioning apparatus 1000 as an example of the refrigeration cycle apparatus.

As shown in FIG. 18, the air-conditioning apparatus 1000 includes a refrigerant circuit in which an outdoor unit 400 and a plurality of indoor units 500A, 500B, 500C, and 500D are connected by refrigerant pipes and through which refrigerant circulates. The four indoor units 500A, 500B, 500C, and 500D are connected in parallel to one another, and are identical in configuration to one another. Although the air-conditioning apparatus 1000 of the present embodiment includes four indoor units 500 here, the number of indoor units 500 that are installed is not limited to four. Pieces of equipment or other devices of the same kind that are for example differentiated by subscripts such as A, B, C, and D may be described with an omission of subscripts in a case in which they do not particularly need to be differentiated or identified. Moreover, how high or low temperatures, pressures, or other parameters are is not determined in relation to absolute values but relatively determined in terms of states, actions, or other conditions in systems, apparatuses, or other devices.

Further, as in the case of Embodiments 1 to 5, the air-conditioning apparatus 1000 includes a controller 3. As in the case of FIG. 1, the controller 3 is provided outside the outdoor unit 400 and the indoor units 500A, 500B, 500C, and 500D. However, this is not intended to impose any limitation, and the controller 3 may be provided inside any of the outdoor unit 400 and the indoor units 500A, 500B, 500C, and 500D.

In the present embodiment, as shown in FIG. 18, the outdoor unit 400 includes a compressor 411, a refrigerant flow switching device 412, an outdoor heat exchanger 413, an outdoor fan 404, an accumulator 14, an expansion device 420, a double pipe 407, and a bypass expansion valve 408.

The compressor 411 sucks in, compresses, and discharges refrigerant. The compressor 411 includes an inverter device or other devices and, by arbitrarily changing its frequency, is configured to finely change the amount of refrigerant that the compressor 411 sends out per unit time.

The refrigerant flow switching device 412, such as a four-way valve, switches, for example, between the flow of refrigerant during cooling operation and the flow of refrigerant during heating operation in accordance with an instruction from an outdoor control device 110. Further, the outdoor heat exchanger 413 exchanges heat between refrigerant and outdoor air. For example, the outdoor heat exchanger 413 operates as an evaporator during heating operation to exchange heat between low-pressure refrigerant having flowed in via the expansion device 420 and air, evaporate, and gasify the refrigerant. Further, the outdoor heat exchanger 413 operates as a condenser during cooling operation to exchange heat between refrigerant that has flowed into the compressor 411 from the refrigerant flow switching device 412 and has compressed in the compressor 411 and air, condense, and liquefy the refrigerant. The outdoor heat exchanger 413 is provided with the outdoor fan 404, which is an air-sending device, for efficient heat exchange between refrigerant and air. A fan motor 405 is a motor configured to drive the outdoor fan 404. A rotation speed of the outdoor fan 404 is also finely changed by arbitrarily changing the drive frequency of the fan motor 405 with an inverter device. Note here that the direction in which the outdoor fan 404 is rotated by the fan motor 405 is a positive rotation.

The double pipe 407, which serves as an inter-refrigerant heat exchanger, exchanges heat between refrigerant flowing through a main flow passage of the refrigerant circuit and refrigerant branching off from the main flow passage and having has its flow rate adjusted by the bypass expansion valve 408. In particular, the double pipe 407 is formed to, in a case in which subcooling of refrigerant is needed during cooling operation, subcool refrigerant and supply the indoor units 500A, 500B, 500C, and 500D with the refrigerant thus subcooled. Liquid flowing via the bypass expansion valve 408 is returned to the accumulator 14 via a bypass pipe. The accumulator 14 is connected to a low-pressure side of the compressor 411 and stores excess refrigerant.

Further, the outdoor unit 400 of the present embodiment includes a high-pressure pressure sensor 415 and a low-pressure pressure sensor 416. The high-pressure pressure sensor 415 detects a pressure in a discharge pipe of the compressor 411. The low-pressure pressure sensor 416 detects a pressure in an inlet pipe of the accumulator 14.

The indoor units 500A, 500B, 500C, and 500D include indoor heat exchangers 522A, 522B, 522C, and 522D and expansion devices 521A, 521B, 521C, and 521D, respectively. Each of the indoor heat exchangers 522A, 522B, 522C, and 522D exchanges heat between refrigerant and air in an air-conditioned space. Each of the indoor heat exchangers 522A, 522B, 522C, and 522D operates as a condenser during heating operation. That is, each of the indoor heat exchangers 522A, 522B, 522C, and 522D exchanges heat between refrigerant having flowed in from a pipe through which gas refrigerant flows and air, condenses the refrigerant into liquid or two-phase gas-liquid refrigerant, and lets out the liquid or two-phase gas-liquid refrigerant. Meanwhile, each of the indoor heat exchangers 522A, 522B, 522C, and 522D operates as an evaporator during cooling operation. That is, each of the indoor heat exchangers 522A, 522B, 522C, and 522D exchanges heat between refrigerant brought into a low-pressure state by a corresponding one of the expansion devices 521A, 521B, 521C, and 521D and air, gasifies the refrigerant by causing the refrigerant to remove heat from the air, and lets out the refrigerant thus gasified. Further, the indoor units 500A, 500B, 500C, and 500D are provided with indoor fans 517A, 517B, 517C, and 517D configured to adjust the flow of air with which heat is exchanged. The driving speeds, that is, air volumes of these indoor fans 517A, 517B, 517C, and 517D are determined, for example, by settings configured by a user, although this is not intended to impose any particular limitation. The expansion devices 521A, 521B, 521C, and 521D are provided, so that the pressures of refrigerant in the indoor heat exchangers 522A, 522B, 522C, and 522D are adjusted by changing the opening degrees of the expansion devices 521A, 521B, 521C, and 521D.

As shown in FIG. 18, also in Embodiment 6, a liquid-level sensing device 15 is attached to the accumulator 14, as in the case of Embodiments 1 to 5. As the accumulator 14 and the liquid-level sensing device 15 are identical in configuration and operation to those of Embodiment 1, a description of the configurations and operations of the accumulator 14 and the liquid-level sensing device 15 is omitted here.

Also in Embodiment 6, as in the case of Embodiment 1, during start-up of heating or during return to heating after completion of defrosting operation of the air-conditioning apparatus 1000, the liquid-level sensing device 15 senses the liquid level in the accumulator 14 installed in the outdoor unit 400. In a case in which the liquid level in the accumulator 14 is higher than the preset threshold Th, the controller 3 makes the frequency of the compressor 411 installed in the outdoor unit 400 lower than or equal to the preset first specified value Sp1 for the limiting operation. This makes it possible to reduce the occurrence of liquid return to the compressor 411, making it possible to bring about improvement in start-up characteristics of the air-conditioning apparatus 1000. The following describes how the controller 3 operates.

In Embodiment 6, the outdoor heat exchanger 413 is a first heat exchanger, and the indoor heat exchangers 522A, 522B, 522C, and 522D are each a second heat exchanger. Further, the expansion device 420 is a first expansion device, and the expansion devices 521A, 521B, 521C, and 521D are each a second expansion device.

[Process of Controlling Frequency of Compressor 411]

The controller 3 operates in the same manner as in the flow chart of FIG. 9 described above. Therefore, how the controller 3 operates is described with reference to FIG. 9. It should be noted that the controller 3 is configured in the same manner as shown in FIG. 2.

In step S21, the liquid level in the accumulator 14 is sensed by performing the process of the flow chart of FIG. 8 in a state in which the operation of the compressor 411 is stopped.

In step S22, the frequency control unit 36 of the controller 3 determines, on the basis of the liquid level sensed in step S21, whether the liquid level in the accumulator 14 is higher than the threshold Th. Specifically, in a case in which the liquid level in the accumulator 14 is the level a, the frequency control unit 36 determines that the liquid level in the accumulator 14 is higher than the threshold Th, and proceeds to step S23. On the other hand, in a case in which the liquid level in the accumulator 14 is the level b or the level c, the frequency control unit 36 determines that the liquid level is normal, and ends the process of FIG. 9.

In step S23, the frequency control unit 36 of the controller 3 sets the frequency of the compressor 411 to the preset first specified value Sp1 or lower.

Thus, in Embodiment 6, the frequency control unit 36 controls the frequency of the compressor 411 on the basis of the liquid level in the accumulator 14 as sensed by the liquid-level determining unit 32. Specifically, in a case in which the liquid level in the accumulator 14 is higher than the threshold Th, the frequency control unit 36 sets the frequency of the compressor 411 to the first specified value Sp1 or lower. This makes it possible to reduce the suction of low-pressure refrigerant into the compressor 411 upon start-up of the compressor 411, thus making it possible to reduce the occurrence of liquid return from the accumulator 14 to the compressor 411. As a result, this makes it possible to bring about improvement in start-up characteristics of the air-conditioning apparatus 1000 during start-up of heating or during return to heating after completion of defrosting operation of the air-conditioning apparatus 1000.

On the other hand, in a case in which the liquid level in the accumulator 14 is determined to be normal, the frequency control unit 36 controls the frequency of the compressor 411 by a control method for normal operation. That is, the frequency control unit 36 controls the frequency of the compressor 411 such that a target condensing temperature or a target discharge temperature is achieved.

In Embodiment 6, as noted above, during start-up of heating or during return to heating after completion of defrosting operation of the air-conditioning apparatus 1000, the liquid-level sensing device 15 senses the liquid level in the accumulator 14 installed in the outdoor unit 400. In a case in which the liquid level in the accumulator 14 is higher than the threshold Th, the controller 3 makes the frequency of the compressor 411 installed in the outdoor unit 400 lower than or equal to the preset first specified value Sp1. This makes it possible to reduce the suction of low-pressure refrigerant into the compressor 411 upon start-up of the compressor 411, thus making it possible to reduce the occurrence of liquid return to the compressor 411 and making it possible to bring about improvement in start-up characteristics of the air-conditioning apparatus 1000 for heating. This also makes it possible to bring about improvement in reliability of the compressor 411 without making the accumulator 14 complex in structure.

Also in Embodiment 6, as in the case of the modification of Embodiment 1, an amount of increase in the frequency of the compressor 411 may be determined to correspond to an amount of change in the liquid level in the accumulator 14 after the frequency of the compressor 411 has been set to the first specified value Sp1 or lower. In this case, effects that are similar to those of the modification of Embodiment 1 are brought about.

Modification 1 of Embodiment 6

The controller 3 may be configured as shown in FIG. 10, as in the case of Embodiment 2. In this case, the controller 3 performs the following process in accordance with the flow chart of FIG. 11 described above.

In step S31, the liquid level in the accumulator 14 is sensed by performing the process of the flow chart of FIG. 8 in a state in which the operation of the compressor 411 is stopped.

In step S32, the expansion control unit 37 of the controller 3 determines, on the basis of the liquid level sensed in step S31, whether the liquid level in the accumulator 14 is higher than the threshold Th. Specifically, in a case in which the liquid level in the accumulator 14 is the level a, the expansion control unit 37 determines that the liquid level in the accumulator 14 is higher than the threshold Th, and proceeds to step S33. On the other hand, in a case in which the liquid level in the accumulator 14 is the level b or the level c, the expansion control unit 37 determines that the liquid level is normal, and ends the process of FIG. 11.

In step S33, the expansion control unit 37 of the controller 3 sets the opening degree of at least one of the expansion devices 420, 521A, 521B, 521C, and 521D to the preset second specified value Sp2 or higher.

Thus, in Modification 1 of Embodiment 6, the expansion control unit 37 controls the opening degree of at least one of the expansion devices 420, 521A, 521B, 521C, and 521D on the basis of the liquid level in the accumulator 14 as sensed by the liquid-level determining unit 32. Specifically, in a case in which the liquid level in the accumulator 14 is higher than the threshold Th, the expansion control unit 37 sets the opening degree of at least one of the expansion devices 420, 521A, 521B, 521C, and 521D to the second specified value Sp2 or higher for the limiting operation. This makes it possible to reduce the occurrence of liquid return from the accumulator 14 to the compressor 411 upon start-up of the compressor 411. As a result, this makes it possible to bring about improvement in start-up characteristics of the air-conditioning apparatus 1000 during start-up of heating or during return to heating after completion of defrosting operation of the air-conditioning apparatus 1000.

On the other hand, in a case in which the liquid level in the accumulator 14 is determined to be normal, the expansion control unit 37 controls the opening degree of the expansion device 420, 521A, 521B, 521C, or 521D by the control method for normal operation. That is, the expansion control unit 37 controls the opening degree of the expansion device 420, 521A, 521B, 521C, or 521D such that a degree of subcooling SC at an outlet of the outdoor heat exchanger 413 or the indoor heat exchanger 522A, 522B, 522C, or 522D reaches a target degree of subcooling.

In Modification 1 of Embodiment 6, as noted above, during start-up of heating or during return to heating after completion of defrosting operation of the air-conditioning apparatus 1000, the liquid-level sensing device 15 senses the liquid level in the accumulator 14 installed in the outdoor unit 400. In a case in which the liquid level in the accumulator 14 is higher than the threshold Th, the controller 3 sets the opening degree of at least one of the expansion devices 420, 521A, 521B, 521C, and 521D to the second specified value Sp2 or higher. This makes it possible to reduce the suction of low-pressure refrigerant into the compressor 411 upon start-up of the compressor 411, thus making it possible to reduce the occurrence of liquid return to the compressor 411 and making it possible to bring about improvement in start-up characteristics of the air-conditioning apparatus 1000 for heating. This also makes it possible to bring about improvement in reliability of the compressor 411 without making the accumulator 14 complex in structure.

Also in Modification 1 of Embodiment 6, as in the case of the modification of Embodiment 2, an amount of decrease in the opening degree of at least one of the expansion devices 420, 521A, 521B, 521C, and 521D may be determined to correspond to an amount of change in the liquid level in the accumulator 14 after the opening degree of at least a corresponding one of the expansion devices 420, 521A, 521B, 521C, and 521D has been set to the second specified value Sp2 or higher. In this case, effects that are similar to those of the modification of Embodiment 2 are brought about.

Modification 2 of Embodiment 6

Also in Embodiment 6, as in the case of Embodiment 3, as shown in FIG. 12, the bypass 51 may be provided between a high-pressure side that is a refrigerant discharge side of the compressor 411 and a low-pressure side that is an inflow side of the accumulator 14. Further, as shown in FIG. 12, the bypass 51 may be provided with the hot-gas bypass valve 52. As the bypass 51 and the hot-gas bypass valve 52 are identical in configuration and operation to those of Embodiment 3, a description of the configurations and operations of the bypass 51 and the hot-gas bypass valve 52 is omitted here.

In this case, the controller 3 is configured as shown in FIG. 13 described above. Further, the controller 3 controls the opening and closing operations of the hot-gas bypass valve 52 in accordance with the flow chart of FIG. 14 described above.

In Modification 2 of Embodiment 6, as noted above, during start-up of heating or during return to heating after completion of defrosting operation of the air-conditioning apparatus 1000, the liquid-level sensing device 15 senses the liquid level in the accumulator 14 installed in the outdoor unit 400. In a case in which the liquid level in the accumulator 14 is higher than the threshold Th, the controller 3 switches the hot-gas bypass valve 52 from a closed state to an open state for the limiting operation. This causes high-temperature hot gas to flow into the accumulator 14, thus causing liquid refrigerant in the accumulator 14 to evaporate and be delivered to the refrigerant circuit. As a result, this makes it possible to reduce the suction of low-pressure refrigerant into the compressor 411, thus making it possible to reduce the occurrence of liquid return to the compressor 411. As a result, this makes it possible to bring about improvement in start-up characteristics of the air-conditioning apparatus 1000 for heating. This also makes it possible to bring about improvement in reliability of the compressor 411 without making the accumulator 14 complex in structure.

Modification 3 of Embodiment 6

Also in Embodiment 6, as in the case of Embodiment 4, the controller 3 may be configured as shown in FIG. 15 described above.

In this case, the controller 3 performs a process in accordance with the flow chart of FIG. 16 described above. As this process is equivalent to a combination of Embodiment 6, Modification 1 of Embodiment 6, and Modification 2 of Embodiment 6, a description of the process is omitted here.

As noted above, as Modification 3 of Embodiment 6 is a combination of Embodiment 6, Modification 1 of Embodiment 6, and Modification 2 of Embodiment 6, Modification 3 of Embodiment 6 brings about effects that are similar to those of Embodiment 6, Modification 1 of Embodiment 6, and Modification 2 of Embodiment 6.

Further, although air-conditioning apparatuses 1000 are described in Embodiments 1 to 6 as examples of refrigeration cycle apparatuses, this is not intended to impose any limitation, and Embodiments 1 to 6 are also applicable to other refrigeration cycle apparatuses such as hot-water supply apparatuses, freezers, refrigerators, and automatic vending machines.

The invention claimed is:

1. A refrigeration cycle apparatus comprising:

a refrigerant circuit in which a compressor, a first heat exchanger, a first expansion device, a second expansion device, and a second heat exchanger are connected by refrigerant pipes and through which refrigerant circulates;

an accumulator provided to the refrigerant circuit, formed to store liquid refrigerant, and from which gas refrigerant is caused to be sucked into the compressor;

a liquid-level sensing device provided to the accumulator and configured to sense a liquid level of the liquid refrigerant stored in the accumulator;

a controller configured to, in a case in which the liquid level sensed by the liquid-level sensing device is higher than a threshold, perform a limiting operation of reducing an amount of suction of the gas refrigerant that is sucked from the accumulator into the compressor and, in a case in which the liquid level is lower than or equal to the threshold, perform a normal operation;

a bypass through which a discharge side of the compressor and an inflow side of the accumulator are connected; and a bypass valve provided to the bypass and configured to open and close to circulate or intercept the gas refrigerant flowing through the bypass, the controller is further configured to in a case in which the liquid level sensed by the liquid-level sensing device is higher than the threshold, make a frequency of the compressor lower than or equal to a first specified value for the limiting operation, in a case in which the liquid level sensed by the liquid-level sensing device is higher than the threshold, make an opening degree of at least either the first expansion device or the second expansion device higher than or equal to a second specified value for the limiting operation, and in a case in which the liquid level sensed by the liquid-level sensing device is higher than the threshold, switch the bypass valve from a closed state to an open state for the limiting operation.

2. The refrigeration cycle apparatus of claim 1, wherein the liquid-level sensing device includes a plurality of temperature sensors sequentially arranged in different positions in a height direction of the accumulator and configured to sense surface temperatures of the accumulator, and the liquid-level sensing device is configured to sense, using the surface temperatures sensed by the plurality of temperature sensors, the liquid level of the liquid refrigerant stored in the accumulator.

3. The refrigeration cycle apparatus of claim 1, wherein the liquid-level sensing device is configured to sense the liquid level of the liquid refrigerant twice, the controller is further configured to calculate a difference between the liquid level sensed by the liquid-level sensing device for a first time and the liquid level sensed by the liquid-level sensing device for a second time as an amount of change and determine, by using a table on which amounts of increase in the frequency of the compressor are predetermined for respective amounts of change, an amount of increase in the frequency of the compressor that corresponds to the calculated amount of change.

4. The refrigeration cycle apparatus of claim 1, wherein the liquid-level sensing device is configured to sense the liquid level of the liquid refrigerant twice, the controller is further configured to calculate a difference between the liquid level sensed by the liquid-level sensing device for a first time and the liquid level sensed by the liquid-level sensing device for a second time as an amount of change and determine, by using a table on which amounts of decrease in the opening degree of at least either the first expansion device or the second expansion device are predetermined for respective amounts of change, an amount of decrease in the opening degree that corresponds to the calculated amount of change for the at least either the first expansion device or the second expansion device.

* * * * *